US007256775B2

(12) United States Patent
Eom

(10) Patent No.: US 7,256,775 B2
(45) Date of Patent: Aug. 14, 2007

(54) LIGHT EMITTING DISPLAY

(75) Inventor: Ki-Myeong Eom, Suwon-Si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 168 days.

(21) Appl. No.: 11/155,995

(22) Filed: Jun. 17, 2005

(65) Prior Publication Data

US 2005/0285827 A1 Dec. 29, 2005

(30) Foreign Application Priority Data

Jun. 29, 2004 (KR) ..... 10-2004-0049298

(51) Int. Cl.
*G09G 5/00* (2006.01)

(52) U.S. Cl. ..... 345/204; 345/76; 315/169.3

(58) Field of Classification Search ..... 315/169.1, 315/169.2, 169.3; 345/44–46, 55–56, 204, 345/212–214, 99–100, 76, 102
See application file for complete search history.

(56) References Cited

U.S. PATENT DOCUMENTS 7,129,643 B2 * 10/2006 Shin et al. ..... 315/169.3
2003/0227262 A1 * 12/2003 Kwon ..... 315/169.3
2005/0237001 A1 * 10/2005 Hayafuji ..... 315/169.2

* cited by examiner

*Primary Examiner*—Douglas W. Owens
*Assistant Examiner*—Jimmy Vu
(74) *Attorney, Agent, or Firm*—Christie, Parker & Hale, LLP

(57) ABSTRACT

A light emitting display including a selection signal unit, an emission control signal unit and a plurality of pixels. The selection signal unit receives a first start signal, generates a first shift signal, generates a selection signal using the first shift signal, and outputs the selection signal. The emission control signal unit receives a clock signal and a second start signal, generates a second shift signal, generates first and second emission control signals using the first and second shift signals, and outputs the emission control signals. At least one of the pixels includes first and second light emitting elements. The first light emitting element is emitted by the first emission control signal in the first field, and the second light emitting element is emitted by the second emission control signal in the second field.

24 Claims, 18 Drawing Sheets

LIGHT EMITTING DISPLAY

CROSS REFERENCE TO RELATED APPLICATION

This application claims priority to and the benefit of Korean Patent Application No. 10-2004-0049298 filed on Jun. 29, 2004 in the Korean Intellectual Property Office, the entire content of which is incorporated herein by reference.

BACKGROUND OF THE INVENTION

1. Field of the Invention

The present invention relates to a light emitting display, and more particularly to an organic light emitting diode (OLED) light emitting display utilizing electroluminescent (EL) light emission of an organic material.

2. Discussion of the Related Art

Generally, OLED displays emit light by electrically exciting an organic compound. Such an OLED display includes N×M organic light emitting diodes arranged in the form of a matrix, and displays an image by driving the organic light emitting cells, using voltage or current.

Such organic light emitting cells are also called "organic light emitting diodes (OLEDs)" because they have diode characteristics. As shown in FIG. 1, each organic light emitting diode has a structure including an anode electrode layer (e.g., ITO), an organic layer, and a cathode electrode layer (e.g., metal). The organic layer has a multi-layer structure including an emitting layer (EML), an electron transport layer (ETL), and a hole transport layer (HTL), to achieve an improved balance between electrons and holes, and thus, to achieve an enhancement in light emitting efficiency. The organic layer also includes an electron injecting layer (EIL) and a hole injecting layer (HIL). Such organic light emitting diodes are arranged in the form of an N×M matrix to form an OLED display panel.

For driving methods for such an OLED display panel, there are a passive matrix type of driving method and an active matrix type of driving method using thin film transistors (TFTs). In accordance with the passive matrix type of driving method, anodes and cathodes are arranged to be orthogonal to each other so that a desired line to be driven is selected. In accordance with the active matrix type of driving method, thin film transistors are coupled to respective indium tin oxide (ITO) pixel electrodes in an OLED display panel so that the OLED display panel is driven by a voltage maintained by a capacitor coupled to the gate of each thin film transistor.

FIG. 1 shows a circuit diagram for representing one of N×M pixels as a conventional pixel circuit, equivalently representing a pixel arranged in a first row and a first column.

As shown in FIG. 1, a pixel 10 includes three sub-pixels 10*r*, 10*g*, and 10*b*. The sub-pixels 10*r*, 10*g*, and 10*b* respectively include OLED elements OLED_r, OLED_g, and OLED_b for respectively emitting red, green, and blue lights. In a configuration in which sub-pixels are arranged in a stripe pattern, the sub-pixels 10*r*, 10*g*, and 10*b* are respectively coupled to data lines D1*r*, D1*g*, and D1*b*, and are commonly coupled to a scan line S1.

The sub-pixel 10*r* for emitting the red light includes two transistors M1*r* and M2*r*, and a storage capacitor C1*r* for driving the OLED element OLED_r. The sub-pixel 10*g* for emitting the green light includes two transistors M1*g* and M2*g*, and a storage capacitor C1*g*. The sub-pixel 10*b* for emitting the blue light includes two transistors, M1*b* and M2*b*, and a storage capacitor C1*b*. Operations of the sub-pixels 10*r*, 10*g*, and 10*b* are substantially the same as each other, and therefore only the operation of the sub-pixel 10*r* will be described.

The driving transistor M1*r* is coupled between a first power source VDD and an anode of the OLED element OLED_r, and transmits a current to the OLED element OLED_r to emit the OLED element OLED_r. The cathode of the OLED element OLED_r is coupled to a second power source VSS which provides a voltage lower than that of the first power source. Current of the driving transistor M1*r* is controlled by a data voltage applied through a switching transistor M2*r*. The capacitor C1*r* is coupled between a source and a gate of the transistor M1*r*, and it maintains an applied voltage for a predetermined period of time. A gate of the transistor M2*r* is coupled to the scan line S1 for transmitting a switching signal, and a source of the transistor M2*r* is coupled to the data line D1*r* for transmitting a data voltage corresponding to the sub-pixel 10*r* for emitting a red light.

A data voltage $V_{DATA}$ from the data line D1*r* is applied to the gate of the transistor M1*r* when the switching transistor M2*r* is turned on in response to a selection signal applied to the gate of the transistor M2*r*. A current of $I_{OLED}$ flows to the transistor M1*r* correspondingly to a voltage of $V_{GS}$ charged between the gate and the source by the capacitor C1*r*, and the OLED element OLED_r is emitted corresponding to the current of $I_{OLED}$. At this time, the current of $I_{OLED}$ flowing through the OLED element OLED_r is given as Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

In the pixel circuit shown in FIG. 1, when a current corresponding to the data voltage is supplied to the OLED element OLED_r, the OLED element OLED_r is emitted with a brightness corresponding to the supplied current. At this time, the applied data voltage has various values within a predetermined range in order to express predetermined gray scales.

As shown, the OLED light emitting display includes the pixel 10 including the three sub-pixels 10*r*, 10*g*, and 10*b*. The respective sub-pixels include a driving transistor, a switching transistor, and a capacitor for driving an OLED element. A data line for transmitting a data signal and a power line for applying the first power source VDD are formed for each sub-pixel. Accordingly, the OLED light emitting display must include a large number of lines and other elements. The lines are difficult to arrange in a limited display area, and aperture efficiency corresponding to an emitting pixel area is reduced. Therefore a pixel circuit for reducing the number of lines and elements for driving a pixel should be developed.

SUMMARY OF THE INVENTION

In one exemplary embodiment according to the present invention, a light emitting display in which one pixel driving element is commonly coupled to a plurality of light emitting elements, and therefore the number of lines and elements is reduced, is provided.

In another exemplary embodiment according to the present invention, a light emitting display including a driving apparatus for applying a signal in order to sequentially emit a plurality of light emitting elements commonly coupled to a pixel driving element, is provided.

Additional features of the invention will be set forth in the description which follows, and in part will be apparent from the description.

In an exemplary embodiment of the present invention, a light emitting display including a display area, a scan driver, and an emission control driver, is provided.

The display area includes a plurality of data lines for transmitting data signals for displaying an image, a plurality of selection signal lines for transmitting a selection signal, a plurality of first and second emission control signal lines for transmitting first and second emission control signals, and a plurality of pixels respectively coupled to the data lines and the selection signal lines.

The scan driver generates a first signal having a first pulse and shifts the first signal by a first period, and shifts the selection signal having a second pulse by the first period using the first signal and sequentially transmits the selection signal to the plurality of selection signal lines in a first field and a second field.

The emission control driver generates a second signal having a third pulse and shifts the second signal by the first period in the first field and the second field. The emission control driver also shifts the first emission control signal having a fourth pulse by the first period using the first signal and the second signal and sequentially transmits the first emission control signal to the plurality of first emission control signal lines in the first field. The emission control driver also shifts the second emission control signal having a fifth pulse by the first period using the first signal and the second signal and sequentially transmits the second emission control signal to the plurality of second emission control signal lines in the second field.

At least one of the pixels includes first and second light emitting elements, the first light emitting element is emitted by the fourth pulse of the first emission control signal in the first field, and the second light emitting element is emitted by the fifth pulse of the second emission control signal in the second field.

One of the data signals corresponding to the first light emitting element may be transmitted to a corresponding one of the data lines while the second pulse of the selection signal is applied in the first field, and another one of the data signals corresponding to the second light emitting element may be transmitted to the corresponding one of the data lines while the second pulse of the selection signal is applied in the second field.

The scan driver may include a shift register for shifting the first signal having the first pulse by the first period and generating the first signal, and a first circuit unit for outputting the selection signal having the second pulse when the first pulse of the first signal and the first pulse of the first signal shifted by the first period are concurrently applied.

The emission control driver may include a shift register for shifting the second signal having the third pulse by the first period and generating the second signal, a second circuit unit for outputting the first signal having the first pulse as the first emission control signal in a period when the third pulse of the second signal is applied, and a third circuit unit for outputting the first signal having the first pulse as the second emission control signal in a period when the third pulse of the second signal is not applied.

The period in which the third pulse of the second signal is applied may correspond to the first field.

In another exemplary embodiment of the present invention, a light emitting display including a display area, a scan driver, and an emission control driver, is provided.

The display area includes a plurality of data lines for transmitting a data signal for displaying an image, a plurality of selection signal lines for transmitting a selection signal, a plurality of first and second emission control signal lines for transmitting first and second emission control signals, and a plurality of pixels respectively coupled to the data lines and the selection signal lines.

The scan driver generates a first signal having a first pulse and shifts the first signal by a first period. The scan driver also shifts a selection signal having a second pulse by the first period using the first signal and sequentially transmits the selection signal to the plurality of selection signal lines. The scan driver also generates a second signal in which the first pulse of the first signal is shifted by a second period, in a first and a second field.

The emission control driver generates a third signal having a third pulse and shifts the third signal by the first period in the first field and the second field. The emission control driver also sequentially transmits the first emission control signal having a fourth pulse to the plurality of first emission control signal lines using the second signal and the third signal in the first field, and sequentially transmits the second emission control signal having a fifth pulse to the plurality of second emission control signal lines using the second signal and the third signal in the second field.

At least one of the pixels includes first and second light emitting elements, the first light emitting element is emitted by the fourth pulse of the first emission control signal in the first field, and the second light emitting element is emitted by the fifth pulse of the second emission control signal in the second field.

The scan driver may include a shift register for shifting the first signal having the first pulse by the first period and sequentially generating the first signal, a first circuit unit for outputting the selection signal having the second pulse when the first pulse of the first signal and the first pulse of the first signal shifted by the first period are concurrently applied, and a second circuit unit for shifting the first pulse of the first signal by the second period.

The second circuit unit may include a third circuit unit for receiving the first signal and a sixth signal having the first pulse, and generating a seventh signal having the first pulse when the first pulse of the first signal and the first pulse of the sixth signal are concurrently applied, a fourth circuit unit for receiving a signal which is generated by shifting the first signal by the first period and an inversion signal of the sixth signal, and generating an eighth signal having the first pulse when the first pulse of the signal generated by shifting the first signal by the first period and the first pulse of the inversion signal of the sixth signal are concurrently applied, and a fifth circuit unit for receiving the seventh and eighth signals, and generating the second signal.

The third and fourth circuit units may include NAND gates, and the fifth circuit unit may include an OR gate.

The emission control driver may include a shift register for shifting a third signal having the third pulse by the first period and sequentially generating the third signal, a sixth circuit unit for outputting the second signal having the first pulse as the first emission control signal in a period when the third pulse of the third signal is applied, and a seventh circuit unit for outputting the second signal having the first pulse as the second emission control signal in a period when the third pulse of the third signal is not applied.

In yet another exemplary embodiment of the present invention, a light emitting display is provided. The light emitting display includes a plurality of selection signal lines for transmitting a selection signal, a plurality of first and second emission control signal lines for respectively transmitting first and, second emission control signals, and a scan driver for generating the selection signal and the first and second emission control signals, applying the selection signal to the selection signal lines, and applying the emission control signals to the first and second emission control signal lines.

The scan driver includes a selection signal unit for generating a first shift signal to be sequentially shifted, sequentially generating the selection signal using the first shift signal, and applying the selection signal to the selection signal lines, and an emission control signal unit for generating a second shift signal to be sequentially shifted, generating the first and second emission control signals using the first shift signal and the second shift signal, and respectively applying the first and second emission control signals to the first and second emission control signal lines.

The selection signal unit may include a shift register for receiving a first clock signal and a start signal, and sequentially generating the first shift signal, and a first circuit unit for outputting the selection signal using the first shift signal.

The first circuit unit may generate the selection signal using two sequential first shift signals.

The first circuit unit may output the selection signal having a second level while the two sequential first shift signals have a first level.

The first level may be a high level, the second level may be a low level, and the first circuit may include a NAND gate.

The emission control signal unit may include a shift register for receiving a second clock signal and a start signal, and generating the second shift signal, and a second circuit unit for outputting the first and second emission control signals using the second shift signal and the first shift signal.

The second circuit unit may include a third circuit unit for outputting the first shift signal as the first emission control signal when the second shift signal is at a first level, and a fourth circuit unit for outputting the first shift signal as the second emission control signal when the second shift signal is at a second level.

The first level may be a high level, and the second level may be a low level.

The third circuit unit may include an inverter to which the first shift signal is input, and a NAND gate to which an output of the inverter and the second shift signal are input.

The fourth circuit unit may include a NOR gate to which the first shift signal and the second shift signal are input, and an inverter for inverting the output signal of the NOR gate.

In yet another exemplary embodiment according to the present invention, a light emitting display is provided. The light emitting display includes a plurality of selection signal lines for transmitting a selection signal, a plurality of first and second emission control signal lines for respectively transmitting first and second emission control signals, and a scan driver for generating the selection signal and the first and second emission control signals, and respectively applying them to the selection signal lines and the first and second emission control signal lines.

The scan driver includes a selection signal unit for generating a first shift signal to be sequentially shifted, sequentially generating the selection signal using the first shift signal, applying the selection signal to the selection signal lines, and generating a second shift signal using the first shift signal, and an emission control signal unit for generating a third shift signal to be sequentially shifted, sequentially generating the first and second emission control signals using the second shift signal and the third shift signal, and respectively applying the first and second emission control signals to the first and second emission control signal lines.

The selection signal unit may include a shift register for receiving a first clock signal and a start signal, and sequentially generating the first shift signal, a first circuit unit for outputting the selection signal using the first shift signal, and a second circuit unit for outputting the second shift signal using the first shift signal.

The second circuit unit may generate the second shift signal using two sequential first shift signals and a second clock signal.

The second clock signal may lead the first clock signal by the first period, and the second shift signal may lag behind the first shift signal by the first period.

BRIEF DESCRIPTION OF THE DRAWINGS

The accompanying drawings, together with the specification, illustrate certain exemplary embodiments of the present invention, and, together with the description, serve to explain the principles of the present invention.

DETAILED DESCRIPTION

Figure 1:
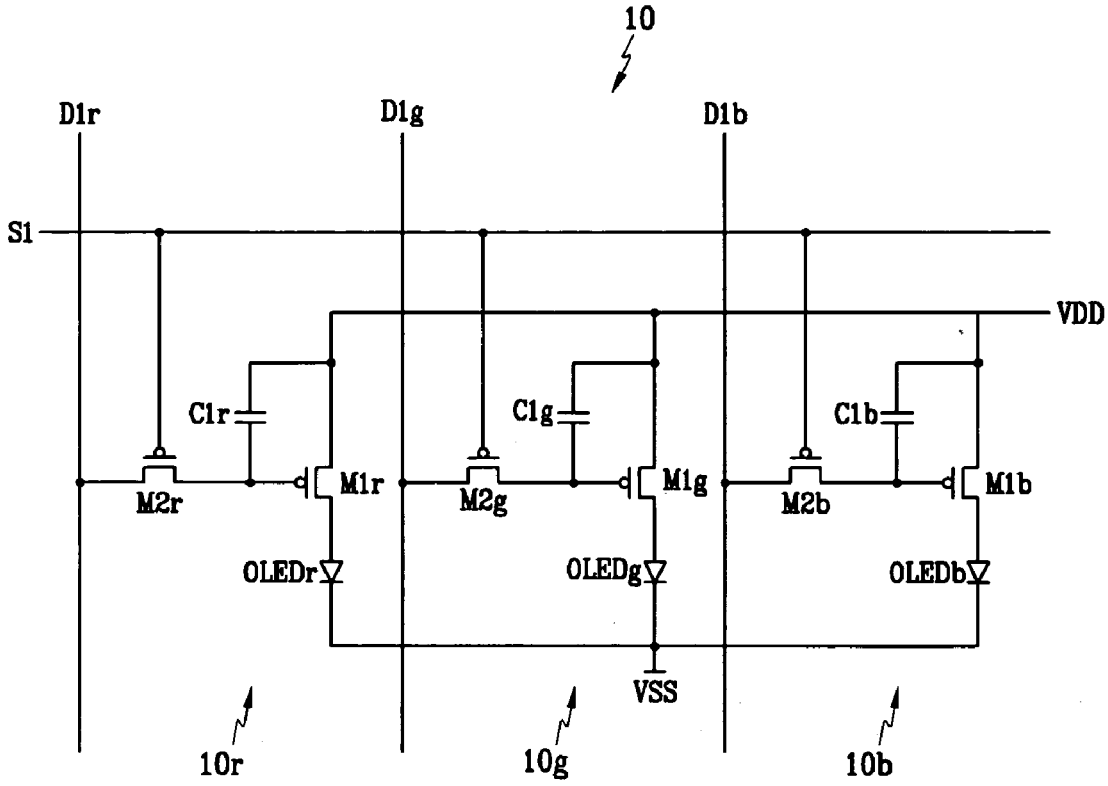
FIG.1 Prior Art
FIG. 1 is a circuit diagram of a pixel circuit of a conventional light emitting display panel.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Like reference numerals designate like elements.

Exemplary embodiments of the present invention will now be described in detail with reference to the attached drawings.

A scan line for transmitting a present selection signal will be referred to as "a present scan line," and a scan line for transmitting a selection signal before the present selection signal is transmitted will be referred to as "a previous scan line." A pixel for emitting based on a selection signal of the present scan line will be referred to as "a present pixel," and a pixel for emitting based on a selection signal of the previous scan line will be referred to as "a previous pixel."

Figure 2:
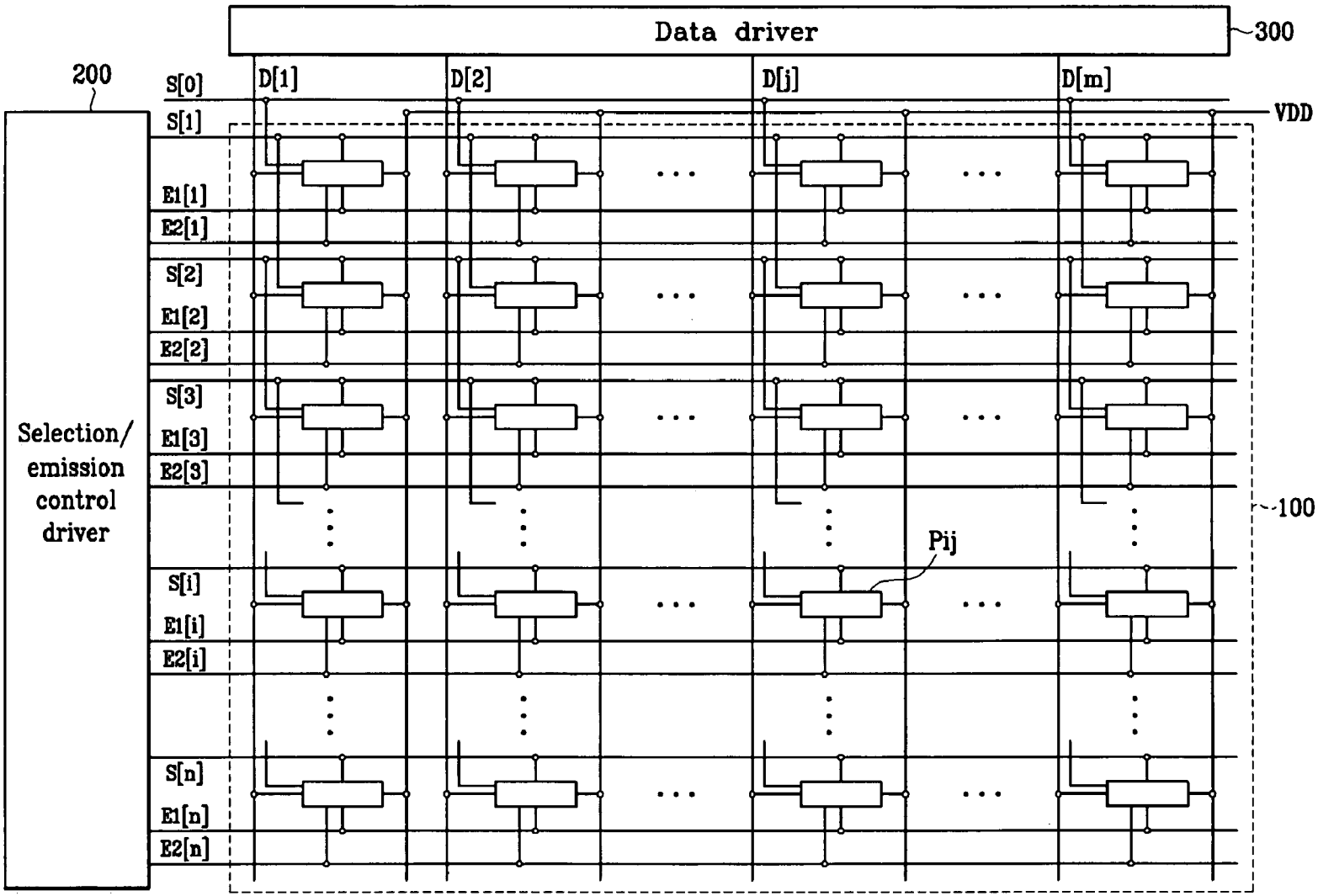
FIG. 2 schematically shows a configuration of an OLED light emitting display according to an exemplary embodiment of the present invention.

FIG. 2 schematically shows a configuration of an OLED light emitting display according to an exemplary embodiment of the present invention.

As shown in FIG. 2, the OLED light emitting display according to the exemplary embodiment of the present invention includes a display panel 100, a selection/emission control driver 200, and a data driver 300. The display panel 100 includes a plurality of selection signal lines S[0], S[i] and a plurality of emission control signal lines E1[i] and E2[i] arranged in a row direction, and a plurality of data lines D[j], a plurality of power lines VDD, and a plurality of pixels Pij arranged in a column direction. As used herein, 'i' is a natural number between 1 and n, and 'j' is a natural number between 1 and m.

As shown in FIG. 2, a pixel Pij is provided in a pixel area defined by two neighboring predetermined selection signal lines. S[i] and S[i+1] and two neighboring predetermined data lines D[j] and D[j+1], and includes two OLED elements selected from a red OLED element, a green OLED element, and a blue OLED element. In other embodiments, the pixels areas may be defined by two neighboring predetermined selection signal lines S[i−1] and S[i] and two neighboring predetermined data lines D[j−1] and D[j]. In the pixel Pij, the two OLED elements operate to emit a light according to a time division method based on a data signal applied from one data line D[j] in response to signals transmitted by the present selection signal line S[i], the previous selection signal line S[i−1], the emission control signal lines E1[i] and E2[i], and the data line D[j]. For the purpose of emitting two OLED elements in a pixel Pij according to the time division method, emission control signals applied to the emission control signal lines E1[i] and E2[i] control two OLED elements included in a pixel to be selectively emitted.

The selection/emission control driver 200 sequentially transmits a selection signal for selecting a line to the selection signal lines S[0] to S[n] for the purpose of applying a data signal to a pixel corresponding to the line, and sequentially transmits an emission control signal for controlling emission of OLED elements OLED1 and OLED2 to the emission control signal lines E1[i] and E2[i]. The data driver 300 applies a data signal corresponding to a pixel of the line to which the selection signal is applied when the selection signal is sequentially applied to the data lines D[1] to D[m].

The selection/emission control driver 200 and the data driver 300 are respectively coupled to a substrate on which the display panel 100 is formed. Alternately, the selection/emission control driver 200 and/or the data driver 300 may be directly formed on the glass substrate of the display panel 100 so that the selection/emission control driver 200 and/or data driver 300 may be substituted for driving circuits respectively formed on the same layers as those of the selection signal lines, data lines, and transistors. Otherwise, the selection/emission control driver 200 and/or the data driver 300 may also be formed, in the form of a chip, on a flexible printed circuit (FPC), tape carried package (TCP), or tape automatic bonding (TAB) which is coupled to the display panel 100.

In the exemplary embodiment of the present invention, a frame is time-divided into two fields. Two data among the respective red, green, and blue data are programmed into the two fields, and emission occurs. The selection/emission control driver 200 sequentially transmits the selection signal to the selection signal lines S[i] for each field, and sequentially applies the emission control signals to the emission control signal lines E1[i] and E2[i] so that the two OLED elements included in a pixel may emit lights for the respective fields. The data driver 300 applies red, green, blue data signals to the data lines D[j] for each field.

A pixel according to a first exemplary embodiment of the present invention will now be described with reference to FIG. 3.

Figure 3:
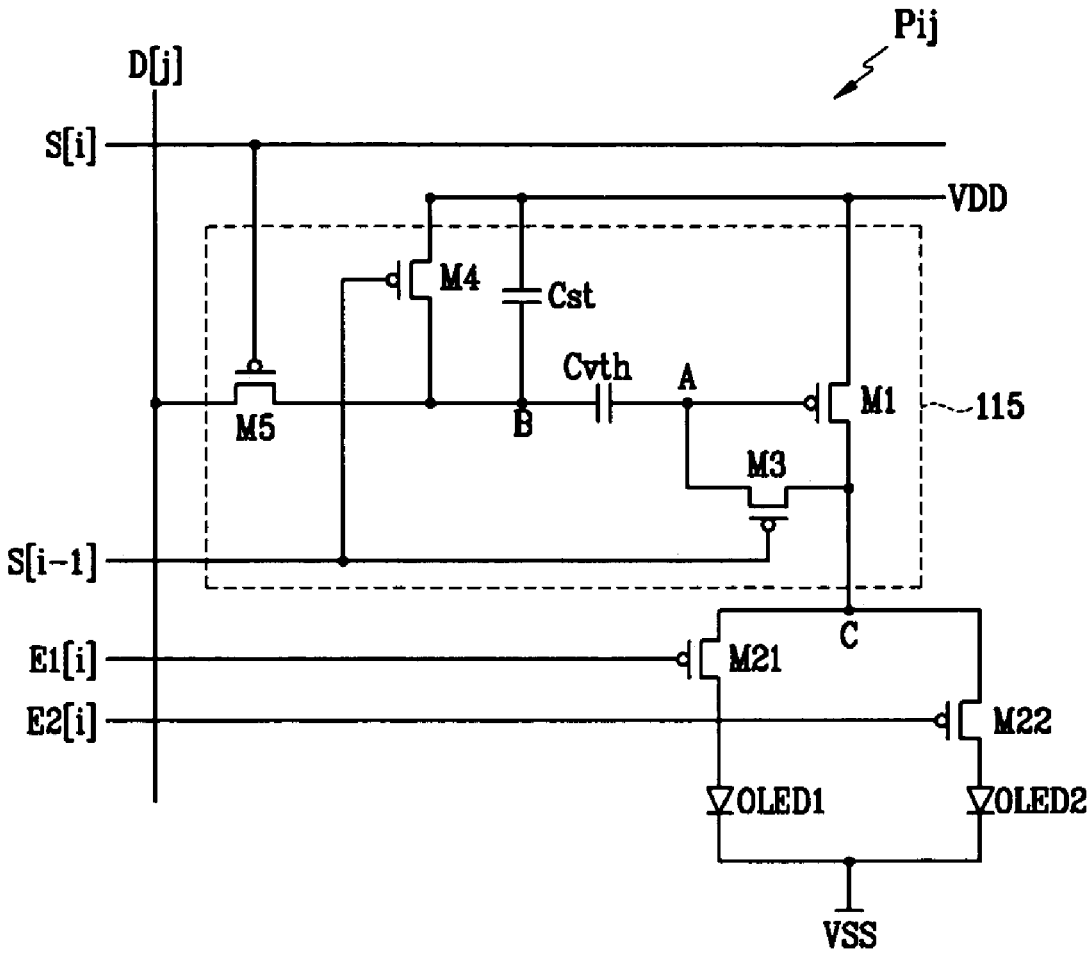
FIG. 3 is a circuit diagram of a pixel Pij of an OLED light emitting display according to the first exemplary embodiment of the present invention.

FIG. 3 is a circuit diagram of a pixel Pij of an OLED light emitting display according to the first exemplary embodiment of the present invention. In FIG. 3, a pixel for using electroluminescence of an organic material is shown as an example, and a pixel in a pixel area formed at an $i^{th}$ row scan line S[i] and a $j^{th}$ column data line D[j] is illustrated as a representative for convenience of description ('i' is an integer between 1 and n, and 'j' is an integer between 1 and m). For convenience of description, the emission control signals applied to the emission control signal lines E1[i] and E2[i] will be represented by E1[i] and E2[i] correspondingly to the emission control signal lines, and the selection signal applied to the selection signal lines S[i] is also represented by S[i] correspondingly to the selection signal lines. OLED elements OLED1 and OLED2 are two of the red, green, and blue OLED elements, and transistors M1, M21, M22, M3, M4, and M5 are represented as p-channel transistors.

As shown in FIG. 3, the pixel circuit Pij includes a pixel driving circuit unit 115, the two OLED elements OLED1 and OLED2, and the transistors M21 and M22 for controlling the two OLED elements OLED1 and OLED2 to be selectively emitted.

The pixel driving circuit unit 115 is coupled to the selection signal line S[i] and the data line D[j], and generates a current to be applied to the OLED elements OLED1 and OLED2 with response to the data signal transmitted through the data line D[j]. The pixel driving circuit unit 115 according to the exemplary embodiment of the present invention includes the four transistors M1, M3, M4, and M5, and two capacitors Cvth and Cst. The present invention covers the modifications and variations of the pixel driving circuit unit provided that they generate a current to be applied to the OLED elements OLED1 and OLED2.

A gate of the transistor M5 is coupled to the present selection signal line S[i] and a source of the transistor M5 is coupled to the data line D[j]. The transistor M5 transmits a data voltage applied from the data line D[j] in response to the selection signal from the selection signal line S[i] to a node B of the capacitor Cvth. The transistor M4 allows the node B of the capacitor Cvth to be coupled to a power source for providing voltage VDD in response to the selection signal from the previous selection signal line S[i−1]. The transistor M3 allows the transistor M1 to be diode-connected in response to the selection signal from the previous scan line S[i−1]. The driving transistor M1 is a transistor for driving the OLED elements OLED1 and OLED2, a gate of the transistor M1 is coupled to a node A of the capacitor Cvth, and a source of the transistor M1 is coupled to the power source for providing the voltage VDD. The transistor M1 controls a current applied to the OLED elements OLED1 and OLED2 in response to a voltage applied to its gate.

One electrode of the capacitor Cst is coupled to the power source for providing the voltage VDD, and the other electrode of the capacitor Cst is coupled to a drain electrode (node B) of the transistor M4. One electrode of the capacitor Cvth is coupled to the other electrode of the capacitor Cst, therefore the two capacitors are coupled in series, and the other electrode of the capacitor Cvth is coupled to the gate (node A) of the driving transistor M1.

A drain of the driving transistor M1 is coupled to respective sources of the transistors M21 and M22 for controlling the OLED elements OLED1 and OLED2 to be selectively emitted, and respective gates of the transistors M21 and M22 are coupled to the respective emission control signal lines E1[i] and E2[i]. Respective drains of the transistors M21 and M22 are coupled to anodes of the OLED elements OLED1 and OLED2, and a power source for providing a voltage of VSS which is less than the voltage of VDD is applied to cathodes of the OLED elements OLED1 and OLED2. By way of example, a negative voltage or a ground voltage is used as the voltage of VSS.

Figure 4:
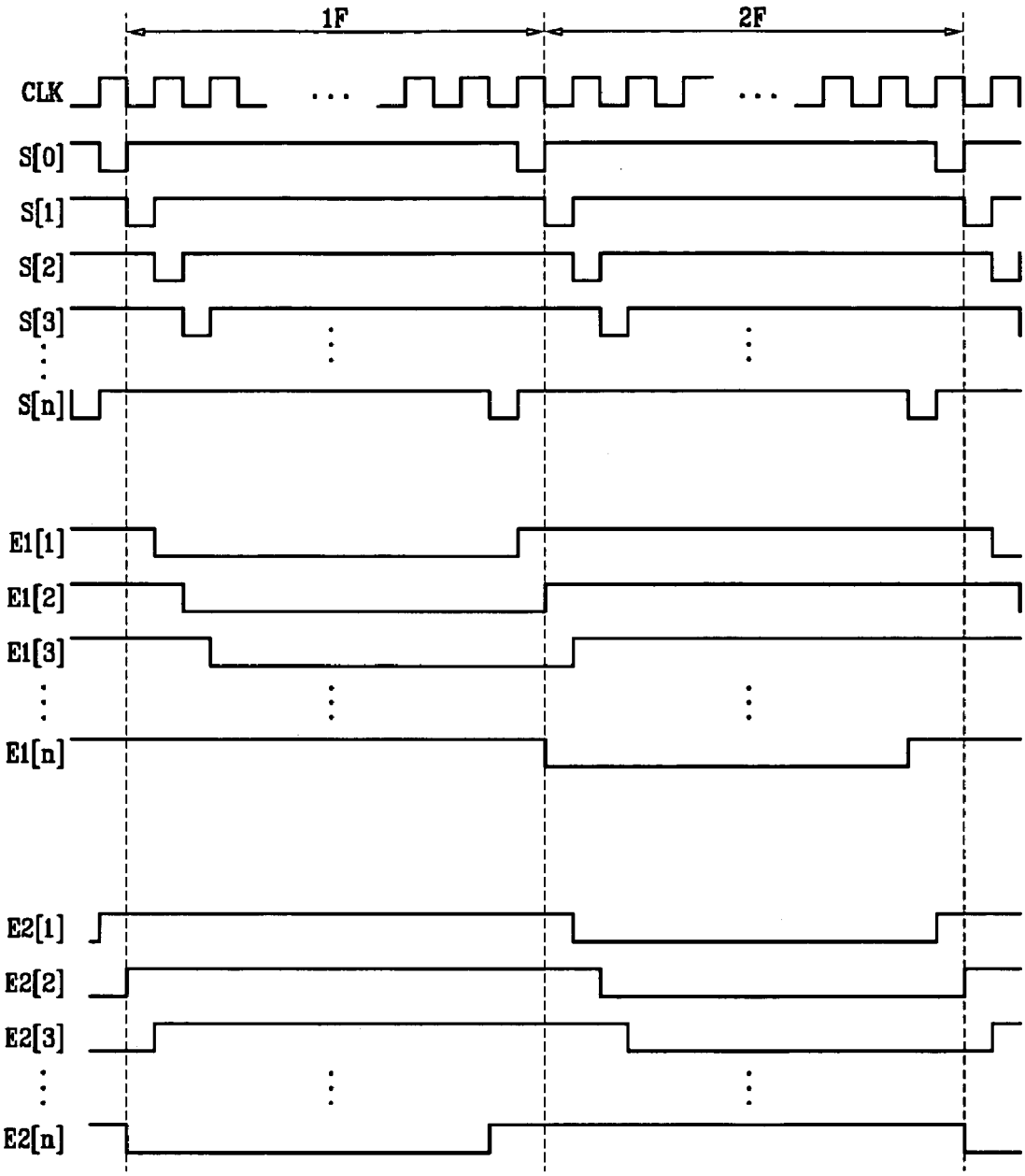
FIG. 4 is a signal timing diagram of the OLED light emitting display according to the first exemplary embodiment of the present invention.

A method for driving the OLED light emitting display according to the first exemplary embodiment of the present invention will now be described with reference to FIG. 4. FIG. 4 shows a signal timing diagram of the OLED light emitting display according to the first exemplary embodiment of the present invention. For convenience of description, the emission control signals applied to the emission control signal lines E1[i] and E2[i] will be represented by E1[i] and E2[i] correspondingly to the emission control signal lines, and the selection signal applied to the selection signal lines S[i] is also represented by S[i] correspondingly to the selection signal lines (where i is an integer between 1 and n). For the signal lines S[i], n can also take on the value of 0. A data voltage applied to the $j^{th}$ data line D[j] is represented by D[j] (where j is an integer between 1 and m).

As shown in FIG. 4, in the OLED light emitting display according to the first exemplary embodiment of the present invention, a frame is divided into two fields 1F and 2F, and the selection signals S[0] to S[n] are sequentially applied in the respective fields 1F and 2F. Two OLED elements OLED1 and OLED2 sharing the driving circuit unit 115 (of FIG. 3) respectively emit a light for a period corresponding to one field. The respective fields 1F and 2F are defined for the respective rows, two fields 1F and 2F are illustrated based on the first row selection signal S[1] in FIG. 4.

In the first field 1F, the transistors M3 and M4 are turned on while a low level selection signal applied to the previous selection signal line S[0] is maintained. The transistor M3 is turned on and the transistor M1 is diode connected. Accordingly, a voltage difference between the gate and the source of the transistor M1 is changed until the voltage difference reaches a threshold voltage Vth of the transistor M1. Since the source of the transistor M1 is coupled to the power source for supplying the voltage of VDD, a voltage applied to the gate of the transistor, i.e., the node A of the capacitor Cvth, is a sum of the voltage VDD and the threshold voltage Vth. The transistor M4 is turned on, the voltage VDD is applied to the node B of the capacitor Cvth, and a voltage of $V_{Cvth}$ charged to the capacitor Cvth is given as Equation 2.

$$V_{Cvth}=V_{CvthA}-V_{CvthB}=(VDD+Vth)-VDD=Vth \quad \text{[Equation2]}$$

where $V_{Cvth}$ represents a voltage charged to the capacitor Cvth, $V_{CvthA}$ represents a voltage applied to the node A of the capacitor Cvth, and $V_{CvthB}$ represents a voltage applied to the node B of the capacitor Cvth.

When a low level selection signal is applied to the present selection signal line S[1] in the first field 1F, the transistor M5 is turned on, and a data voltage Vdata applied from the data line D1 is applied to the node B. A voltage corresponding to the threshold voltage Vth of the transistor M1 is charged to the capacitor Cvth, and therefore a voltage corresponding to a sum of the data voltage Vdata and the threshold voltage Vth of the transistor M1 is applied to the gate of the transistor M1. That is, a voltage of Vgs between the gate and the source of the transistor M1 is given as Equation 3.

$$Vgs=(Vdata+Vth)-VDD \quad \text{[Equation3]}$$

The emission control signal E1[1] and the emission control signal E2[1] are at a high level, and the transistor M21 and the transistor M22 are turned off while the low level selection signal is applied to the previous selection signal line S[0] and the present selection signal line S[1]. Accordingly, a leakage current is prevented from flowing to the OLED elements OLED1 and OLED2.

When a high level signal is applied after the low level selection signal is applied to the present selection signal line S[1], a low level emission control signal is applied to an emission control signal line E1[1], the transistor M21 is turned on, a current of $I_{OLED}$ corresponding to the gate-source voltage $V_{GS}$ of the transistor M1 is supplied to the OLED element OLED1, and therefore the OLED element OLED1 is emitted. The current of $I_{OLED}$ is given as Equation 4.

$$\begin{aligned} I_{OLED} &= \frac{\beta}{2}(Vgs-Vth)^2 \\ &= \frac{\beta}{2}((Vdata+Vth-VDD)-Vth)^2 \\ &= \frac{\beta}{2}(VDD-Vdata)^2 \end{aligned} \quad \text{[Equation 4]}$$

where $I_{OLED}$ denotes a current flowing to the OLED element OLED1, Vgs denotes a voltage between the source and the gate of the transistor M1, Vth is a threshold voltage of the transistor M1, Vdata denotes a data voltage, and β denotes a constant value.

In the second field 2F, the voltage of $V_{Cvth}$ is charged to the capacitor Cvth in the like manner as at the beginning of the first field 1F, while the low level selection signal applied to the previous selection signal line S[0] is maintained. The transistor M5 is turned on and the data voltage Vdata applied from the data line D1 is applied to the node B while the low level selection signal is applied next to the present selection signal line S[1].

The emission control signal E1[1] and the emission control signal E2[1] are at a high level, and the transistor M21 and the transistor M22 are turned off while the low level selection signal is applied to the previous selection signal line S[0] and the present selection signal line S[1]. Accordingly, a leakage current is prevented from flowing to the OLED elements OLED1 and OLED2.

The low level emission control signal is applied to the emission control signal line E2[1], the transistor M22 is turned on, the current of $I_{OLED}$ corresponding to the gate-source voltage $V_{GS}$ of the transistor M1 is supplied to the OLED element OLED2, and the OLED element OLED2 is emitted when the high level signal is applied to the present selection signal line S[1].

In the first field 1F, the emission control signal E1[1] is at the low level while the selection signal S[0] and the selection signal S[1] are at the high level, the emission control signal E2[1] is at the high level in the first field 1F, and therefore a first row OLED element OLED1 is emitted. In the second field 2F, the emission control signal E2[1] is at the low level while the selection signal S[0] and the selection signal S[1] are at the high level, the emission control signal E1[1] is at the high level in the second field 2F, and therefore the first row OLED element OLED2 is emitted.

The selection signals S[i] and the emission control signals E1[i] and E2[i] shown in FIG. 4 are generated and output, for example, by the selection/emission control driver 200 of FIG. 2.

A selection/emission control driver 200' for generating the selection signals S[i] and the emission control signals E1[i] and E2[i] will now be described with reference to FIG. 5 to FIG. 9. The selection/emission control driver 200', for example, can be used as the selection/emission control driver 200 of FIG. 2.

Figure 5:
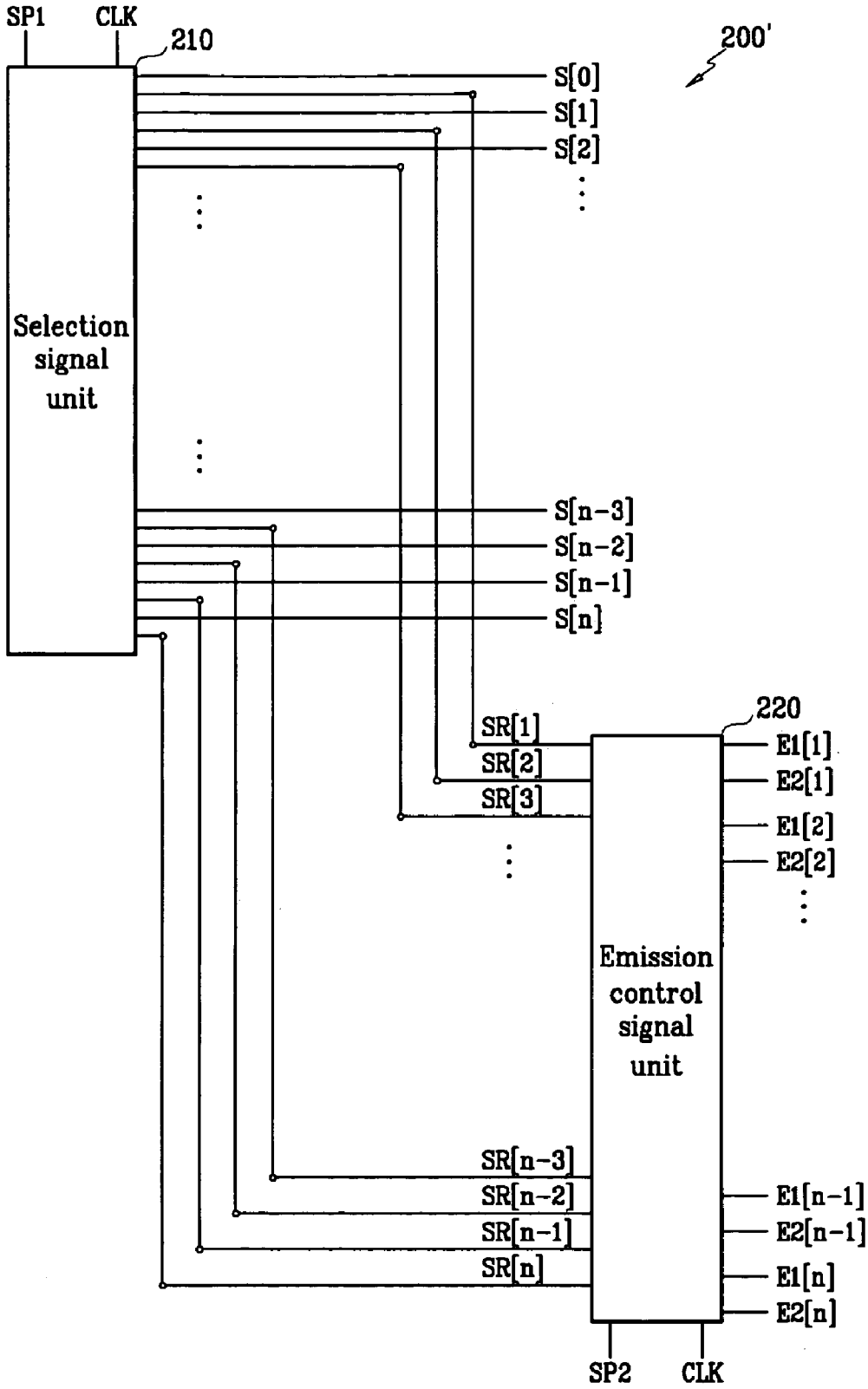
FIG. 5 is a schematic diagram illustrating a configuration of a selection/emission control driver of the OLED light emitting display according to the first exemplary embodiment of the present invention.

FIG. 5 is a schematic diagram of the selection/emission control driver 200' of an OLED light emitting display according to a first exemplary embodiment of the present invention.

The selection/emission control driver 200' includes a selection signal unit 210 and an emission control signal unit 220.

The selection signal unit 210 receives a start signal SP1 and a clock signal CLK and generates signals SR[0] to SR[n] for generating selection signals S[i] and emission control signals E1[i] and E2[i]. The emission control signal unit 220 receives a start signal SP2, a clock signal CLK, and signals SR[1] to SR[n], and generates the emission control signals E1[i] and E2[*i*].

Figure 6:
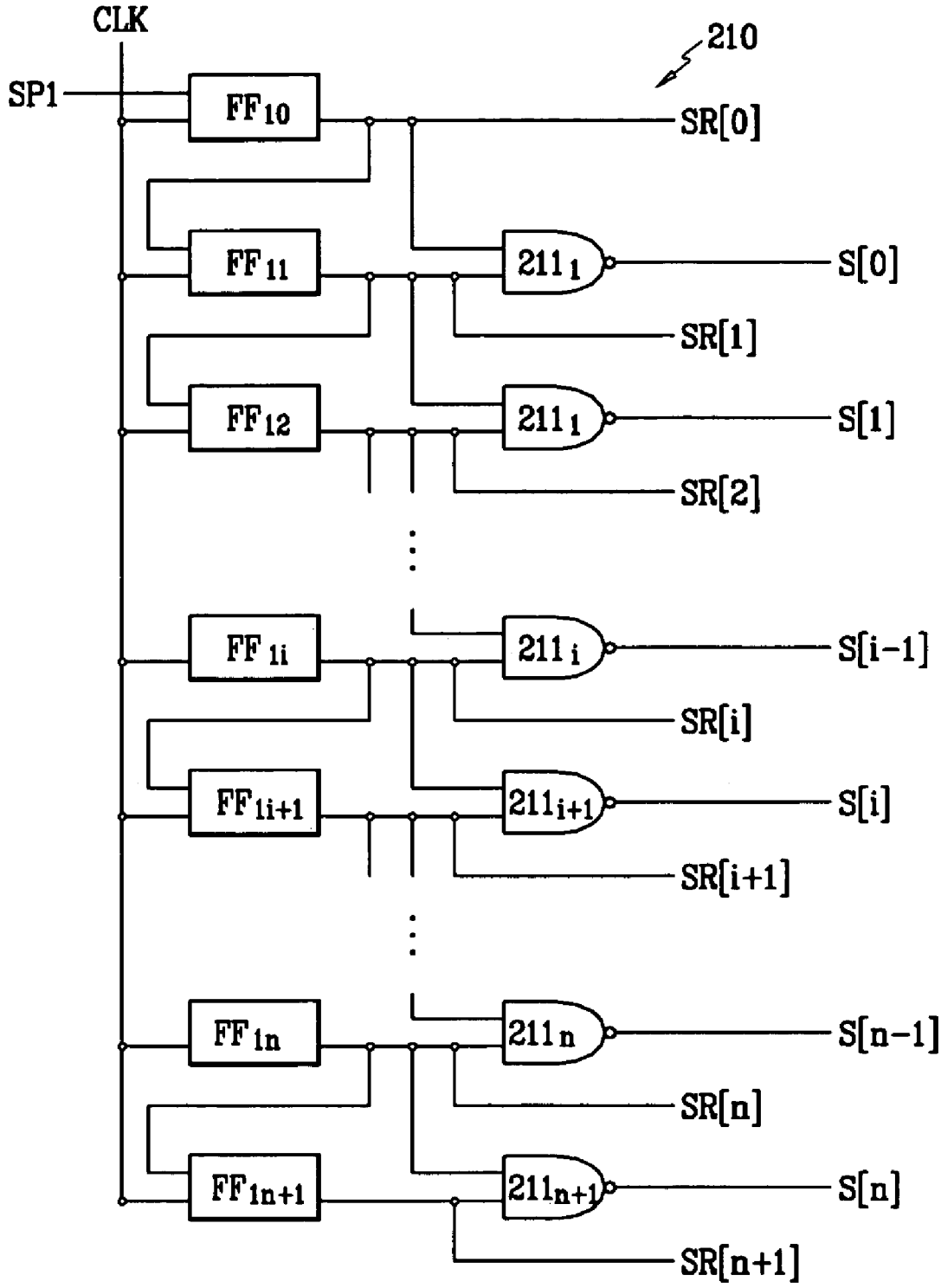
FIG. 6 is a detailed diagram of a configuration of a selection signal unit in the selection/emission control driver of FIG. 5.
Figure 7:
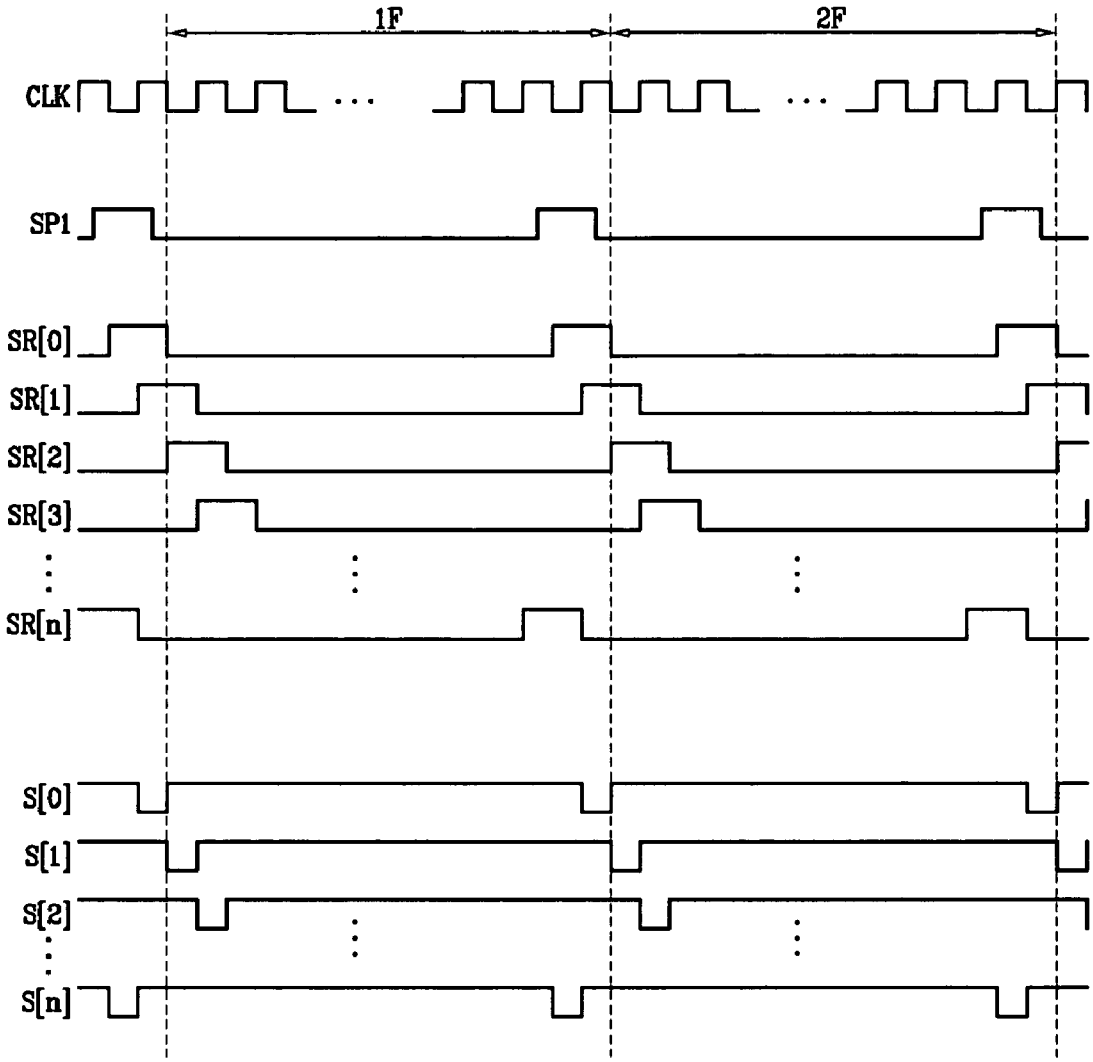
FIG. 7 is a timing diagram of signals from the selection signal unit of FIG. 6.

FIG. 6 is a detailed diagram of a configuration of the selection signal unit 210, and FIG. 7 is a timing diagram of signals from the selection signal unit 210.

The selection signal unit 210 includes a plurality of flip flops $FF_{10}$~$FF_{1n+1}$ for operating as a shift register, and a plurality of NAND gates $211_1$~$211_{n+1}$. As can be seen from FIG. 6 and FIG. 7, the flip flop $FF_{10}$ receives the start signal SP1 and the clock signal CLK, outputs the start signal SP1 while the clock signal is at a low level, latches the start signal SP1 when the clock signal is at the low level, and generates the signal SR[0] while the clock signal CLK is at the high level. A flip flop $FF_{11}$ receives the signal SR[0] and the clock signal CLK, outputs the signal SR[0] while the clock signal is at a high level, latches the signal SR[0] when the clock signal is at the high level, and generates the signal SR[1] while the clock signal CLK is at the low level. That is, the flip flop $FF_{1i}$ receives a signal SR[i−1] generated by the flip flop $FF_{1i-1}$ and the clock signal CLK, and generates a signal SR[i] which is a half clock shifted signal SR[i−1]. The NAND gate $211_i$ receives the signal SR[i−1] and the signal SR[i], and generates a selection signal S[i] having the low level when the two received signals are at the high level. That is, the selection signal unit 210 sequentially generates the signals SR[0] to SR[n] and the selection signal S[0] to S[n].

Figure 8:
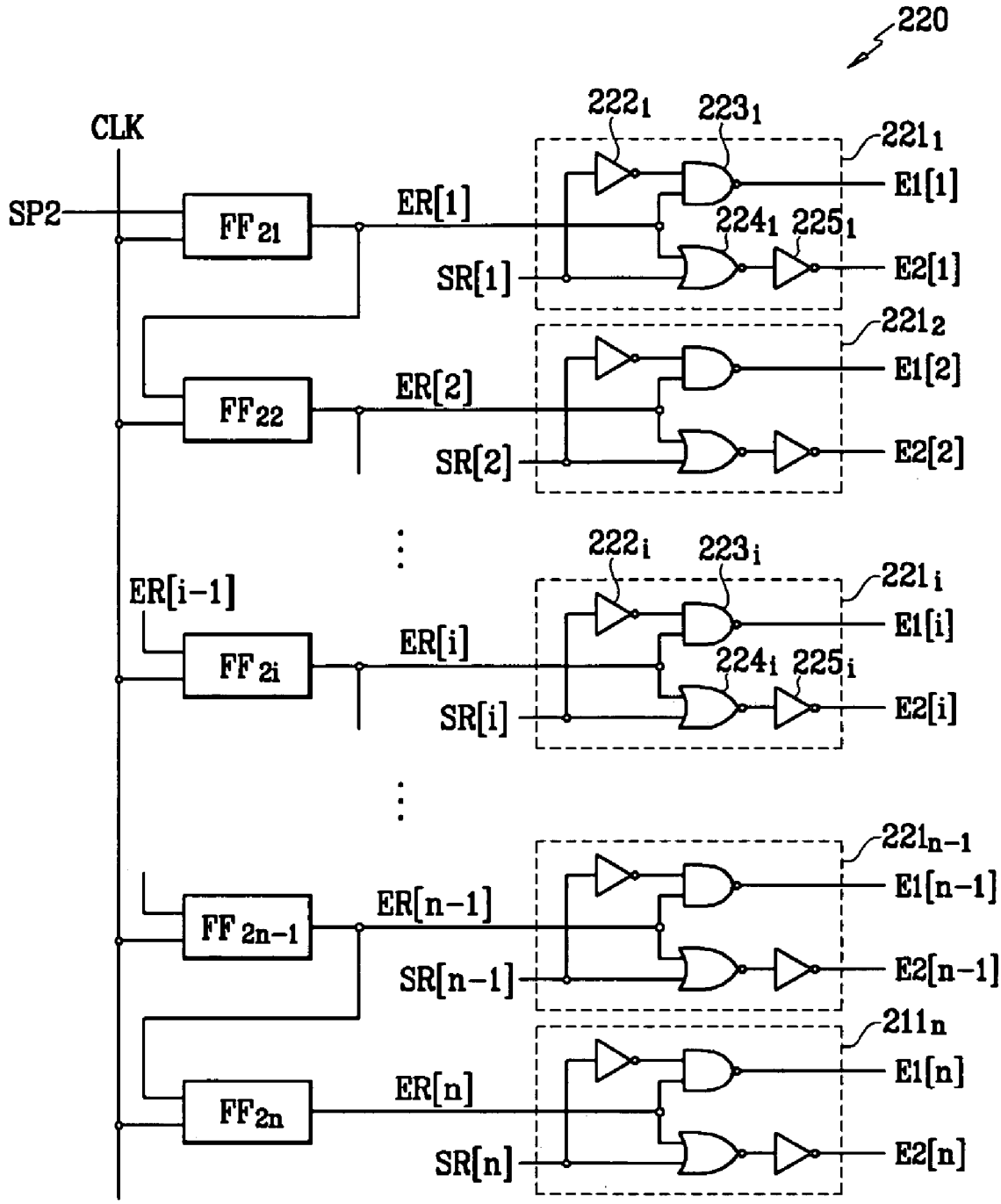
FIG. 8 is a schematic diagram illustrating a configuration of an emission control signal unit in the selection/emission control driver of FIG. 5.
Figure 9:
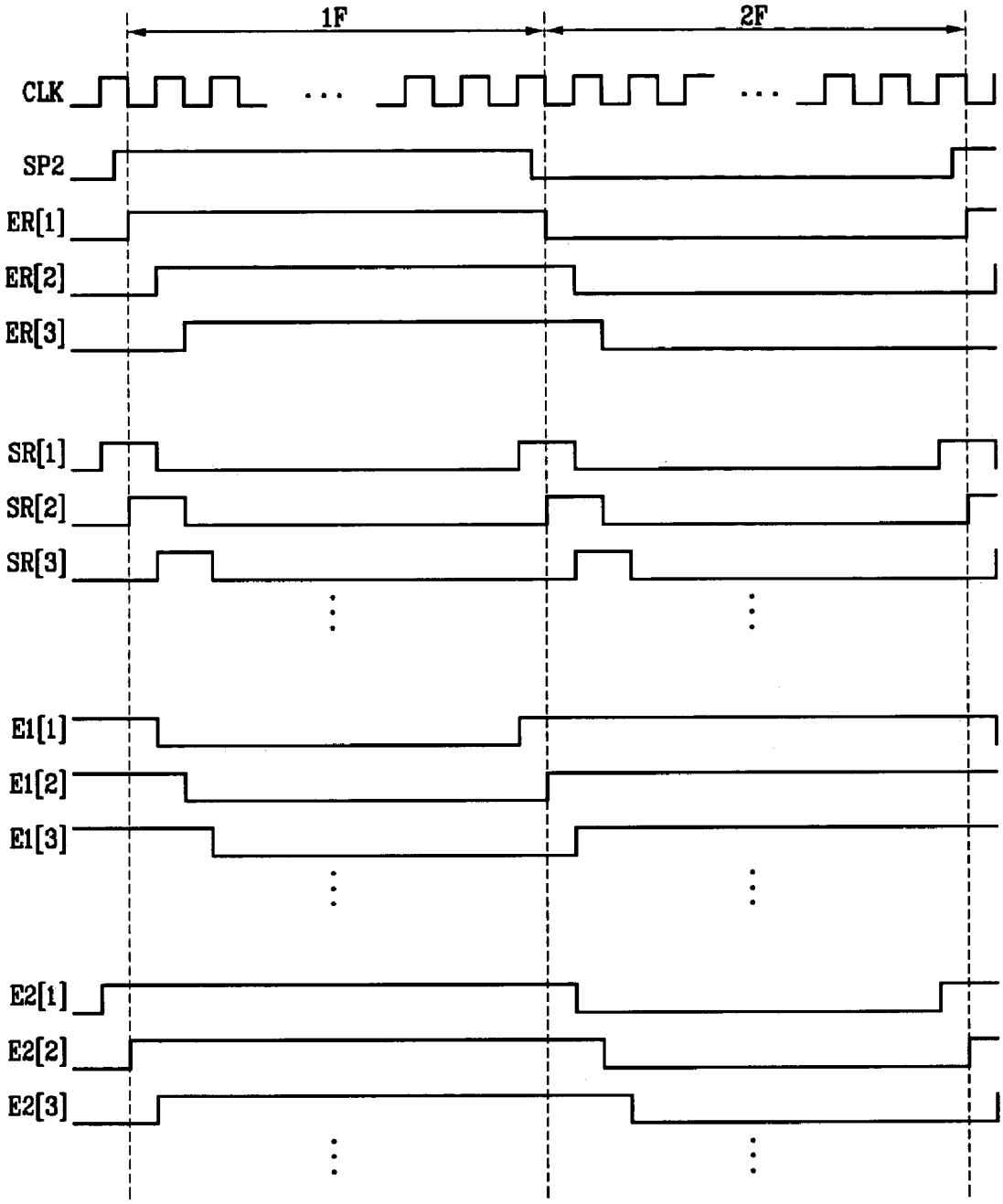
FIG. 9 is a timing diagram of input and output signals of the emission control signal unit of FIG. 8.

FIG. 8 is a schematic diagram of the emission control signal unit 220, and FIG. 9 is a timing diagram of input and output signals of the emission control signal unit 220. As described with reference to FIG. 2, the two OLED elements OLED1 and OLED2 that share the driving circuit unit 115 respectively emit a light for a period corresponding to one field. The two fields 1F and 2F are illustrated with reference to the first row emission control signals E1[1] and E2[1] in FIG. 8.

The emission control signal unit 220 includes a plurality of flip flops $FF_{21}$ to $FF_{2n}$ and a plurality of logic circuit units $221_1$ to $221_n$. The flip flop $FF_{21}$ receives the start signal SP2 and the clock signal CLK, outputs a high level start signal SP2 when the clock signal CLK is at a low level, maintains the start signal in the first field, and generates a signal ER[1]. The flip flop $FF_{22}$ receives the signal ER[1] and the clock signal CLK, outputs a high level signal ER[1] when the clock signal is at the high level, maintains the high level signal in the first field, and generates a signal ER[2]. That is, the flip flop $FF_{2i}$ receives a signal ER[i−1] generated by the flip flop $FF_{2i-1}$ and the clock signal CLK, and generates a signal ER[i].

The logic circuit unit 221 includes two inverters $222_i$ and $225_i$, a NAND gate $223_i$, and a NOR gate $224_i$, receives the signal SR[i] output by the flip flop $FF_{1i}$ of the selection signal unit and the signal ER[i] output by the flip flop $FF_{2i}$, and generates emission control signals E1[i] and E2[i]. The inverter $222_i$ receives the signal SR[i] output by the flip flop $FF_{1i}$ of the selection signal unit 210, and the NAND gate $223_i$ receives an output signal/SR[i] of the inverter $222_i$ and the signal ER[i] output by the flip flop $FF_{2i}$. The NOR gate $224_i$ receives the signal SR[i] and the signal ER[i]. The inverter $225_i$ receives an output of the NOR gate $224_i$, and inverts the output of the NOR gate $224_i$.

Operation of the flip flop $FF_{21}$ and the logic circuit unit $221_1$ will now be described. As shown in FIG. 9, the signal ER[1] is at the high level in the first field 1F and at the low level in the second field 2F. In the first field 1F, the signal SR[1] is at the high level for a first clock, and at the low level for the other clocks.

When the signal ER[1] is at the high level in the first field 1F, the NAND gate $223_1$ outputs the inverted signal SR[1] of the output signal/SR[1] of the inverter $222_1$. The NOR gate $224_1$ receives the high level signal ER[1] and outputs a high level signal regardless of the signal SR[1]. Accordingly, in the first field 1F, a signal corresponding to the signal SR[1] is output as the emission control signal E1[1], and the emission control signal E2[1] is at the high level for a period of the signal SR[1].

In the first field 1F, the emission control signal E1[1] is at the high level while the signal SR[1] is at the high level, and at the low level while the signal SR[1] is at the low level. In the first field 1F, the emission control signal E2[1] is at the high level while the signal SR[1] is at the high level, and at the high level while the signal SR[1] is at the low level. Accordingly, no current is applied to the OLED elements OLED1 and OLED2 while the signal SR[1] is at the high level, the transistor M21 operating with response to the emission E1[1] is turned on while the signal SR[1] is at the low level, a current is applied to the OLED element OLED1, and the OLED element OLED1 is emitted.

When the signal ER[1] is at the low level in the second field 2F, the NAND gate $223_1$ outputs the high level emission control signal E1[1] regardless of another input. The NOR gate $224_1$ receives the low level signal ER[1], and outputs the inverted signal/SR[1] of the signal SR[1]. The signal/SR[1] is inverted by the inverter $225_1$ and the signal SR[1] is output as the emission control signal E2[1]. Accordingly, in the second field 2F, a signal corresponding to the signal SR[1] is output as the emission control signal E2[1], and the emission control signal E1[1] is at the high level for a period of the signal SR[1].

In the second field 2F, the emission control signal E2[1] is at the high level while the signal SR[1] is at the high level, and at the low level while the signal SR[1] is at the low level. In the second field 2F, the emission control signal E1[1] is at the high level while the signal SR[1] is at the high level, and also at the high level while the signal SR[1] is as the low level. Accordingly, no current is applied to the OLED elements OLED1 and OLED2 while the signal SR[1] is at the high level, the transistor M22 operating with response to the emission control signal E2[1] is turned on while the signal is at the low level, a current is applied to the OLED element OLED2, and the OLED element OLED2 is emitted.

In the first field, the logic circuit units $221_2$~$221_n$ respectively generate emission control signals E1[2] to E1[n] corresponding to signals SR[2] to SR[n] and emission control signals E2[2] to E2[n] having the high level. In the second field, the logic circuit units $221_2$ to $221_n$ respectively generate emission control signals E2[2] to E2[n] corresponding to signals SR[2] to SR[n] and emission control signals E1[2] to E1[n] having the high level.

Two emission control signals are generated by one shift register by using logic gates including a NAND gate, a NOR gate, and two inverters. Accordingly, the selection/emission control driver for generating and outputting an emission control signal is efficiently formed, the number of the transistors forming the driver is reduced, a circuit area is reduced, and an error rate generated by the transistor is reduced.

An OLED light emitting display according to a second exemplary embodiment of the present invention will now be described with reference to FIG. 3, and FIG. 10 to FIG. 14.

The OLED light emitting display according to the second exemplary embodiment of the present invention is different from the OLED light emitting display according to the first exemplary embodiment of the present invention in a manner such that the transistor M21 or the transistor M22 is turned on when the transistor M3 that allows the driving transistor M1 to be diode-connected is turned on in FIG. 3, and a potential at a gate node of the driving transistor M1 is initialized.

Figure 10:
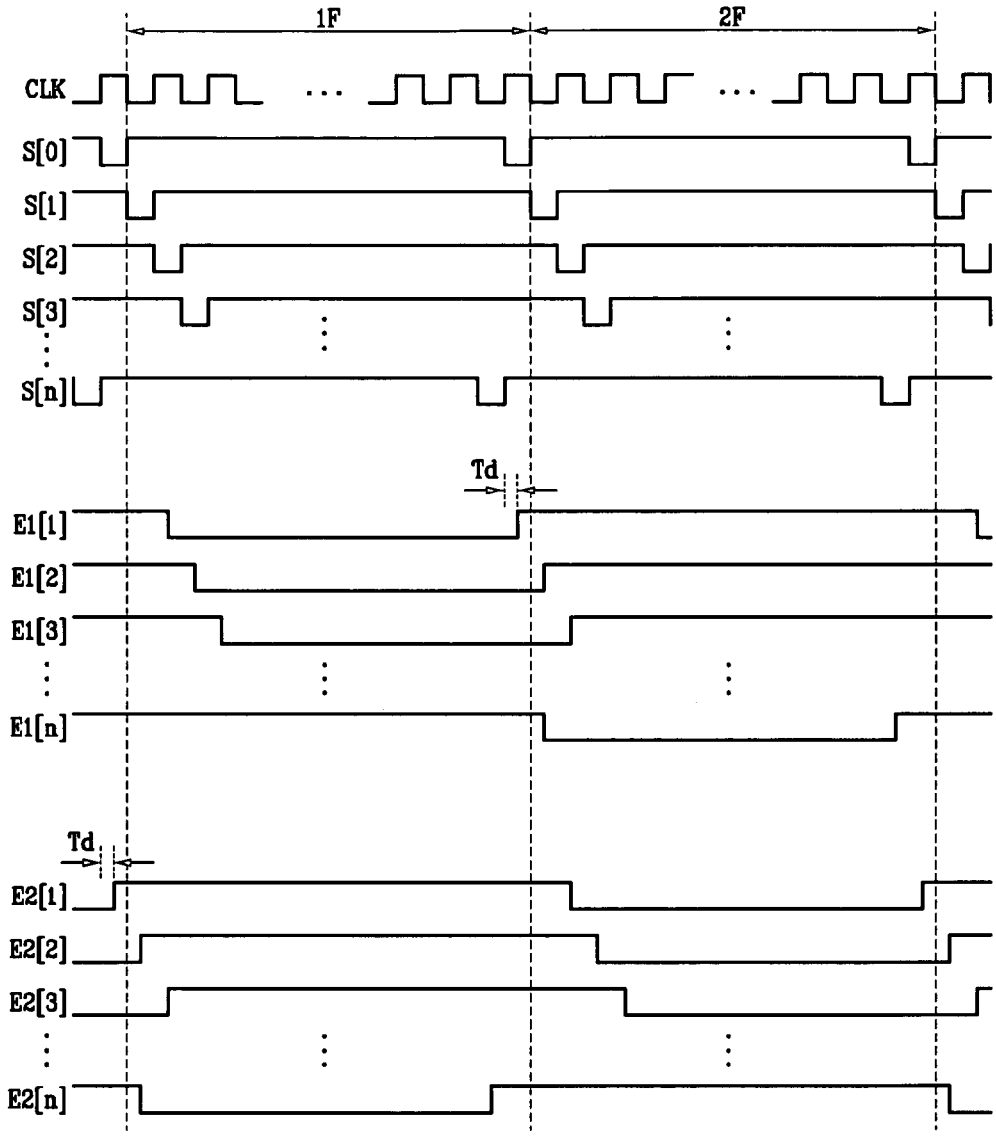
FIG. 10 is a timing diagram of signals of an OLED light emitting display according to a second exemplary embodiment of the present invention.

Operation of a pixel of the OLED light according to the second exemplary embodiment of the present invention will be described with reference to FIG. 3 and FIG. 10. FIG. 10 shows a timing diagram of signals of the OLED light emitting display according to the second exemplary embodiment of the present invention.

In the first field 1F, the transistor M3 and the transistor M4 are turned on while the low level selection signal applied to the previous selection signal line S[0] is maintained. The transistor M3 is turned on, and the transistor M1 is diode-connected. Accordingly, the voltage difference between the gate and the source of the transistor M1 is changed until the voltage difference reaches the threshold voltage Vth of the transistor M1. Since the source of the transistor M1 is coupled to the power source for providing the voltage of VDD, a voltage applied to the gate of the transistor M1, that is, to the node A of the capacitor Cvth, is a sum of the voltage VDD and the threshold voltage Vth of the transistor M1. The transistor M4 is turned on, the voltage VDD is applied to the node B of the capacitor Cvth, and the voltage of $V_{Cvth}$ is charged to the capacitor Cvth.

When the low level selection signal is applied to the previous selection signal line S[0], the low level emission control signal E2[1] is applied for a predetermined time period Td, and the transistor M22 is turned on. Accordingly, the transistor M3 is turned on, the transistor M22 is turned on by the emission control signal E2[1] for the predetermined time period Td, a voltage at a node C becomes a voltage of VSS-Vth, and the capacitor Cvth is initialized. After the predetermined time period Td, the emission control signal E1[1] and the emission control signal E2[1] are at the high level, and therefore a leakage current is prevented from flowing to the OLED elements OLED1 and OLED2 while the capacitor is charged.

While the low level selection signal is applied to the present selection signal line S[1], the transistor M5 is turned on, and the data voltage Vdata applied from the data line D1 is applied to the node B. A voltage corresponding to the threshold voltage Vth of the transistor M1 is charged to the capacitor Cvth, and therefore a voltage corresponding to a sum of the data voltage Vdata and the threshold voltage Vth of the transistor M1 is applied to the gate of the transistor M1.

While the low level selection signal is applied to the present selection signal line S[1], the emission control signal E1[1] and the emission control signal E2[1] are at the high level, the transistor M21 and the transistor M22 are turned off, and therefore a leakage current is prevented from flowing to the OLED elements OLED1 and OLED2.

When the high level signal is applied after the low level selection signal is applied to the present selection signal line S[1], the low level emission control signal is applied to the emission control line E1[1], the transistor M21 is turned on, the current of $I_{OLED}$ corresponding to the gate-source voltage $V_{GS}$ of the transistor M1 is supplied to the OLED element OLED1, and the OLED element OLED1 is emitted.

In the second field 2F, while the low level selection signal applied to the previous selection signal line S[0] is maintained, the voltage of $V_{Cvth}$ is charged to the capacitor Cvth in the like manner as that just prior to the first field 1F. When the low level selection signal is applied to the previous selection signal line S[0], the low level emission control signal E1[1] is applied for the predetermined time period Td, and the transistor M21 is turned on. Accordingly, the transistor M3 is turned on, the transistor M21 is turned on by the emission control signal E1[1] for the predetermined time period Td, a voltage at the node C becomes the voltage of VSS-Vth, and the capacitor Cvth is initialized. A leakage current is prevented from flowing to the OLED elements OLED1 and OLED2 while the capacitor Cvth is charged because a high level signal is applied as the emission control signal E1[1] and the emission control signal E2[1] after the predetermined time period Td.

While the low level selection signal is applied to the present selection signal line S[1], the transistor M5 is turned on, and the data voltage Vdata applied on the data line D1 is applied to the node B. While the low level selection signal is applied to the previous selection signal line S[0] and the present selection signal line S[1], the emission control signal E1[1] and the emission control signal E2[1] are at the high level, the transistor M21 and the transistor M22 are turned off, and a leakage current is prevented from flowing to the OLED elements OLED1 and OLED2. When the high level signal is applied to the present selection signal line S[1], the low level emission control signal is applied to the emission control line E2[1], the transistor M22 is turned on, the current of $I_{OLED}$ corresponding to the gate-source voltage $V_{GS}$ of the transistor M1 is supplied to the OLED element OLED2, and the OLED element OLED2 is emitted.

As shown, while the low level previous selection signal S[i−1] is applied, the low level emission control signal E1[i] or E2[i] is applied for the predetermined time period Td, the transistor M21 or the transistor M22 are turned on, the capacitor Cvth is initialized, and therefore an erroneous operation of the pixel is prevented.

Figure 11:
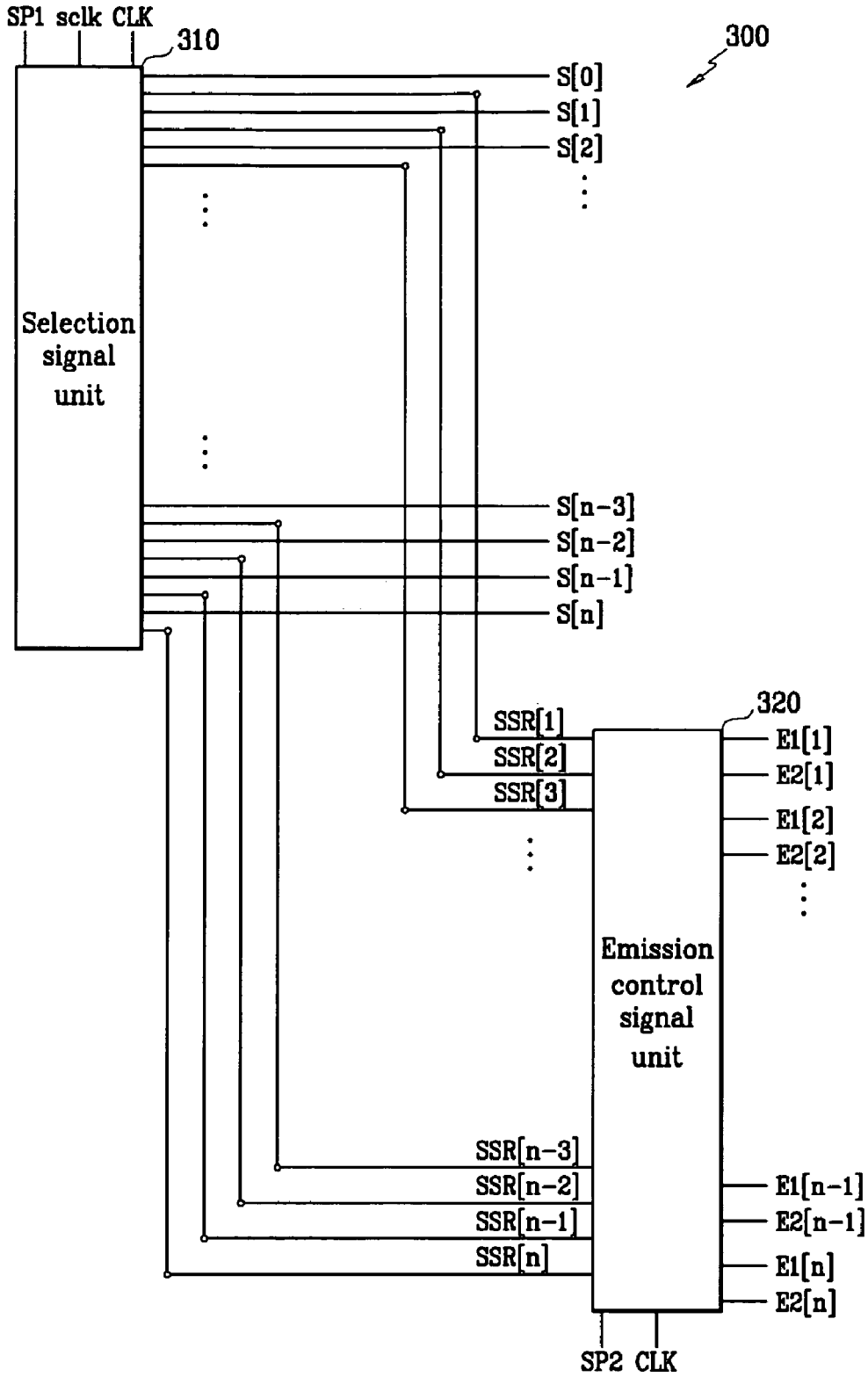
FIG. 11 is a schematic diagram illustrating a configuration of a selection/emission control driver according to the second exemplary embodiment of the present invention.

FIG. 11 schematically shows a configuration of a selection/emission control driver 300 according to the second exemplary embodiment of the present invention. The selection/emission control driver 300, for example, may be used as the selection/emission control driver 200 of FIG. 2.

The selection/emission control driver 300 includes a selection signal unit 310 and an emission control signal unit 320. The selection signal unit 310 receives a start signal SP1, a clock signal sclk, and a clock signal CLK, and generates signals SSR[1] to SSR[n] for generating selection signals S[i] and emission control signals E1[i] and E2[i]. The emission control signal unit 320 receives a start signal SP2, the clock signal CLK, and the signals SSR[1] to SSR[n], and generates the emission control signals E1[i] and E2[*i*].

Figure 12:
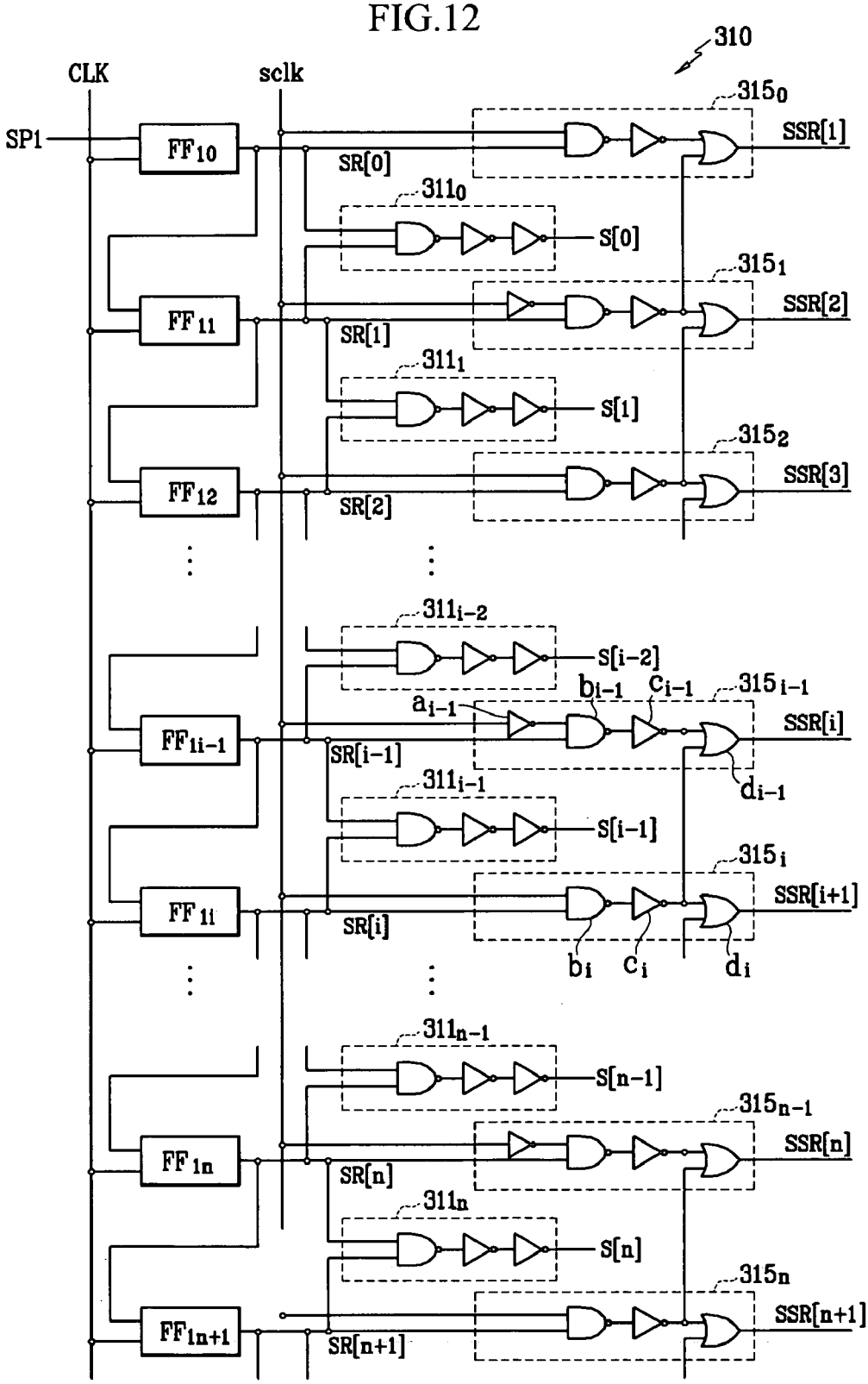
FIG. 12 is a schematic diagram illustrating a configuration of a selection signal unit in the selection/emission control driver of FIG. 11.
Figure 13:
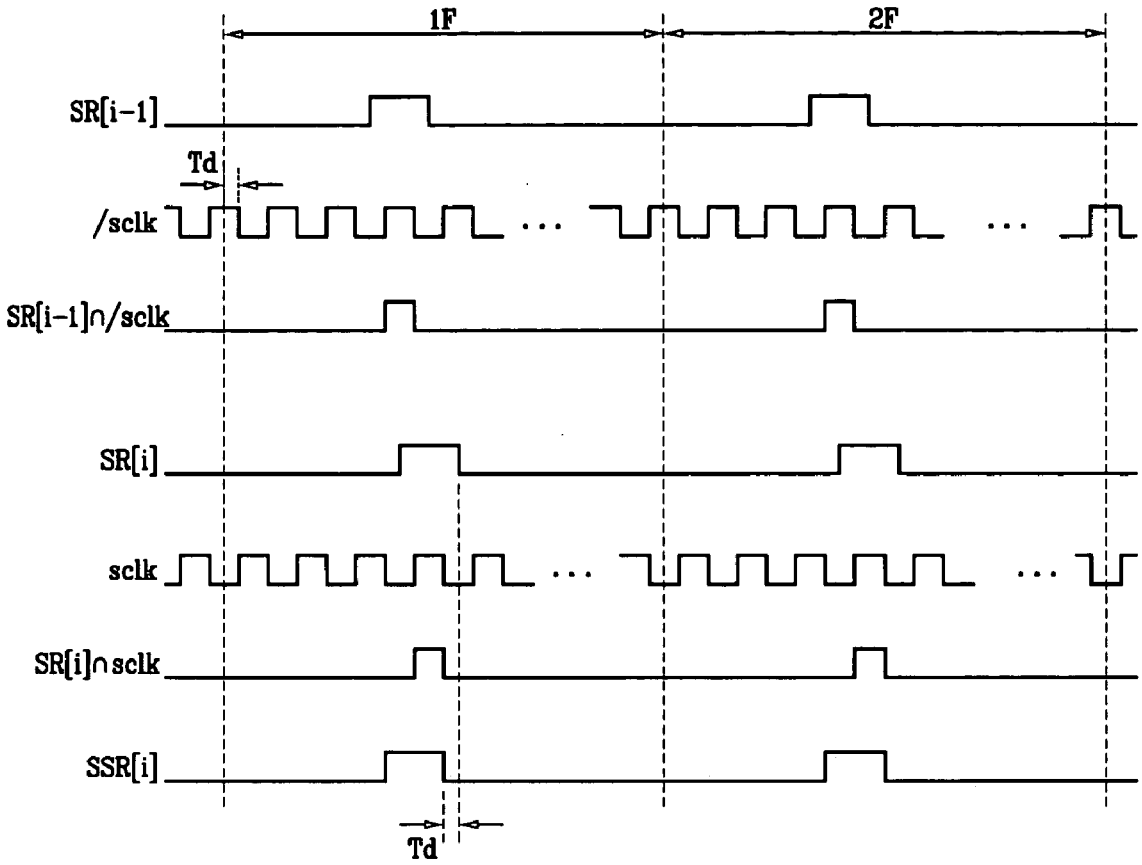
FIG. 13 is a signal timing diagram of an operation of a logic circuit unit in the selection signal unit of FIG. 12.

FIG. 12 schematically shows a configuration of the selection signal unit 310 of the selection/emission control driver 300 of the OLED light emitting display according to the second exemplary embodiment of the present invention. FIG. 13 shows a signal timing diagram of an operation of the logic circuit unit $\mathbf{315}_{i-1}$ shown in FIG. 12.

The selection signal unit 310 includes a plurality of flip flops $FF_{10}$ to $FF_{1n+1}$, a plurality of NAND gate units $\mathbf{311}_i$, a plurality of logic circuits $\mathbf{315}_{i-1}$, and a plurality of logic circuits $\mathbf{315}_i$. The flip flop $FF_{10}$ receives the start signal SP1 and the clock signal CLK, and generates the signal SR[0], and the flip flop $FF_{1i}$ receives the clock signal CLK and the signal SR[i−1] generated by the flip flop $FF_{1i-1}$, and generates the signal SR[i]. The NAND gate unit $\mathbf{311}_i$ receives the signal SR[i−1] and the signal SR[i], and generates the signal S[i] having a low level when the two received signals are at a high level. The NAND gate unit $\mathbf{311}_i$ having two inverters operates correspondingly to the NAND gate unit without the inverters, and a waveform of the output signal S[i] is prevented from being distorted when the two inverters are included.

Each of the plurality of logic circuit units $\mathbf{315}_{i-1}$ includes an inverter $a_{i-1}$ for generating the inverted signal/sclk of the clock signal sclk, which is the clock signal CLK shifted by a predetermined time period Td, a NAND gate $b_{i-1}$ for receiving the signal/sclk and the output signal SR[i−1] of the flip flop $FF_{1i-1}$, an inverter $c_{i-1}$ for inverting the output of the NAND gate $b_{i-1}$, and an OR gate $d_{i-1}$. The OR gate $d_{i-1}$ receives an output of the inverter $c_{i-1}$ of the logic circuit unit $\mathbf{315}_{i-1}$ and an output of the inverter $c_i$ of the logic circuit $\mathbf{315}_i$, and outputs a signal SSR[i]. A phase of the clock signal sclk is ahead of a phase of the clock signal CLK by a predetermined time Td. That is, the clock signal sclk leads in phase over the clock signal CLK.

Each of the plurality of logic circuit units $\mathbf{315}_i$ includes an NAND gate $b_i$ that receives the clock signal sclk, which is shifted by the predetermined time period Td from the clock signal CLK input to the flip flop $FF_{1i}$, and the output signal SR[i] of the flip flop $FF_{1i}$, an inverter $c_i$ for inverting the output of the NAND gate $b_i$, and an OR gate $d_i$. The OR gate $d_i$ receives an output of the inverter $c_{i+1}$ of the logic circuit unit $\mathbf{315}_{i+1}$ and an output of the inverter $c_i$ of the logic circuit unit $\mathbf{315}_i$, and outputs a signal SSR[i+1].

Here, the outputs of the NAND gate $b_{i-1}$ and the inverter $c_{1-1}$ of the logic circuit $\mathbf{315}_{i-1}$ and the outputs of the NAND gate $b_i$ and the inverter $c_i$ of the logic circuit $\mathbf{315}_i$ correspond to an output of an AND gate. Accordingly, the NAND gate $b_{i-1}$ and the inverter $c_{i-1}$, and the NAND gate $b_i$ and the inverter $c_i$ can respectively be realized as one AND gate.

As shown, the selection signal unit 310 according to the second exemplary embodiment of the present invention has a configuration in- which the clock signal logic circuit unit $\mathbf{315}_i$ for receiving the clock signal sclk and the output of the flip flop and outputting the signal SSR, and the inverted clock signal logic circuit unit $\mathbf{315}_{i-1}$ for receiving the output of the flip flop and the inverted clock signal sclk and outputting the signal SSR are alternately provided.

Operation of the selection signal unit 310 will now be described based on the logic circuit unit $\mathbf{315}_{i-1}$ with reference to FIG. 13.

As can be seen from FIG. 12 and FIG. 13, the NAND gate $b_{i-1}$ and the inverter $c_{i-1}$ receive the inverted clock signal/sclk and the output signal SR[i−1] of the flip flop $FF_{1i-1}$, and output a conjunctive signal of (SR[i−1]∩/sclk). The NAND gate $b_i$ and the inverter $c_i$ receive the clock signal sclk and the output signal SR[i]of the flip flop $FF_{1i}$, and output a conjunctive signal of (SR[i]∩sclk). The OR gate $d_{i-1}$ of the logic circuit unit $\mathbf{315}_{i-1}$ performs a disjunction operation of the conjunctive signal of (SR[i−1]∩/sclk) and the conjunctive signal of (SR[i]∩sclk), and outputs the signal SSR[i]. That is, the logic circuit units $\mathbf{315}_0$ to $\mathbf{315}_n$ respectively output the half clock shifted signals SSR[1] to SSR[n+1] in sequence. This way, the signal SSR[i] is delayed in comparison to the signal SR[i] by the predetermined time period Td.

The signals SSR[1] to SSR[n+1] generated and output by the selection signal unit 310 are input to the emission control signal unit 320 shown in FIG. 11.

Figure 14:
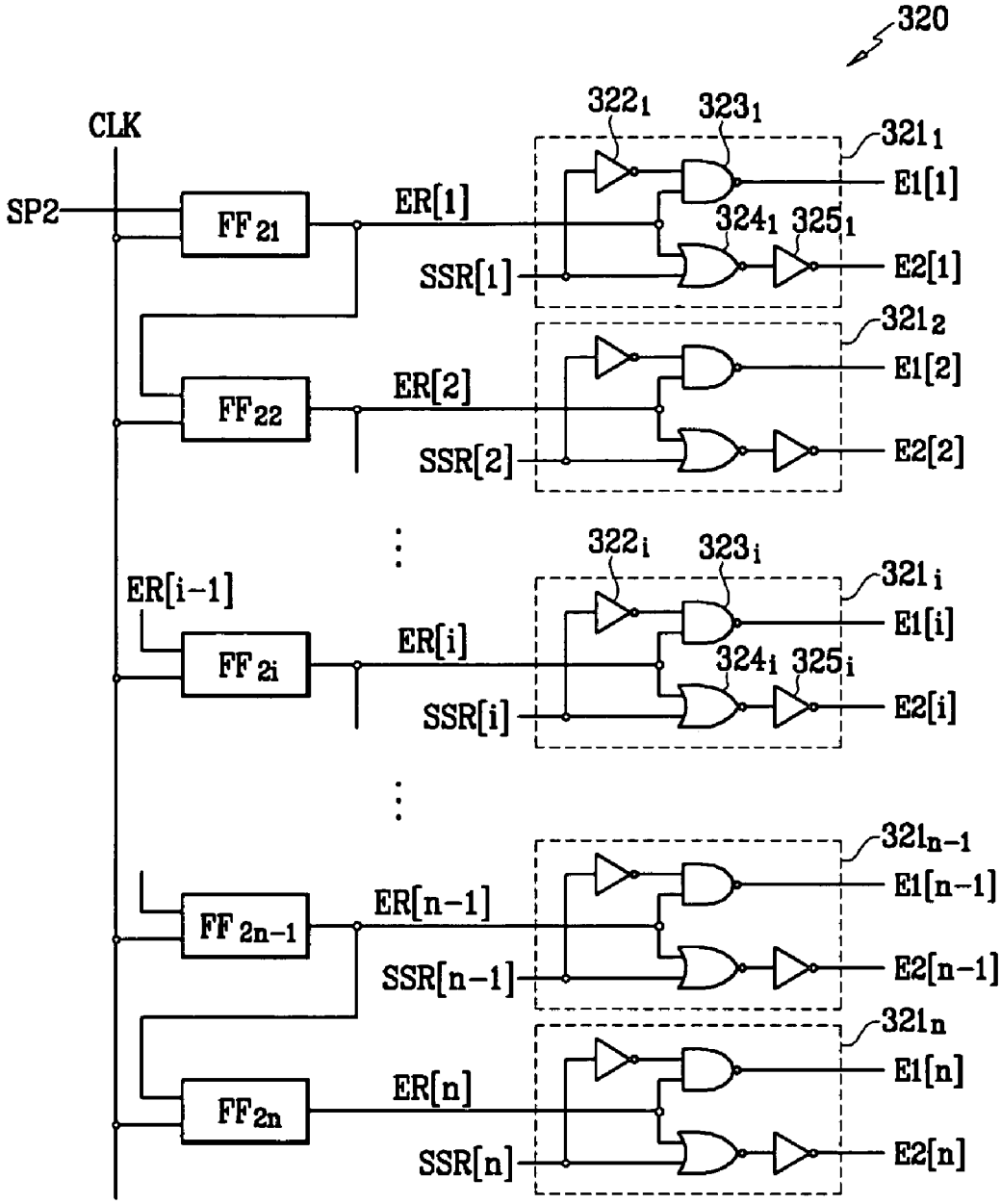
FIG. 14 is a schematic diagram illustrating a configuration of an emission control signal unit in the selection/emission control driver of FIG. 11.
Figure 15:
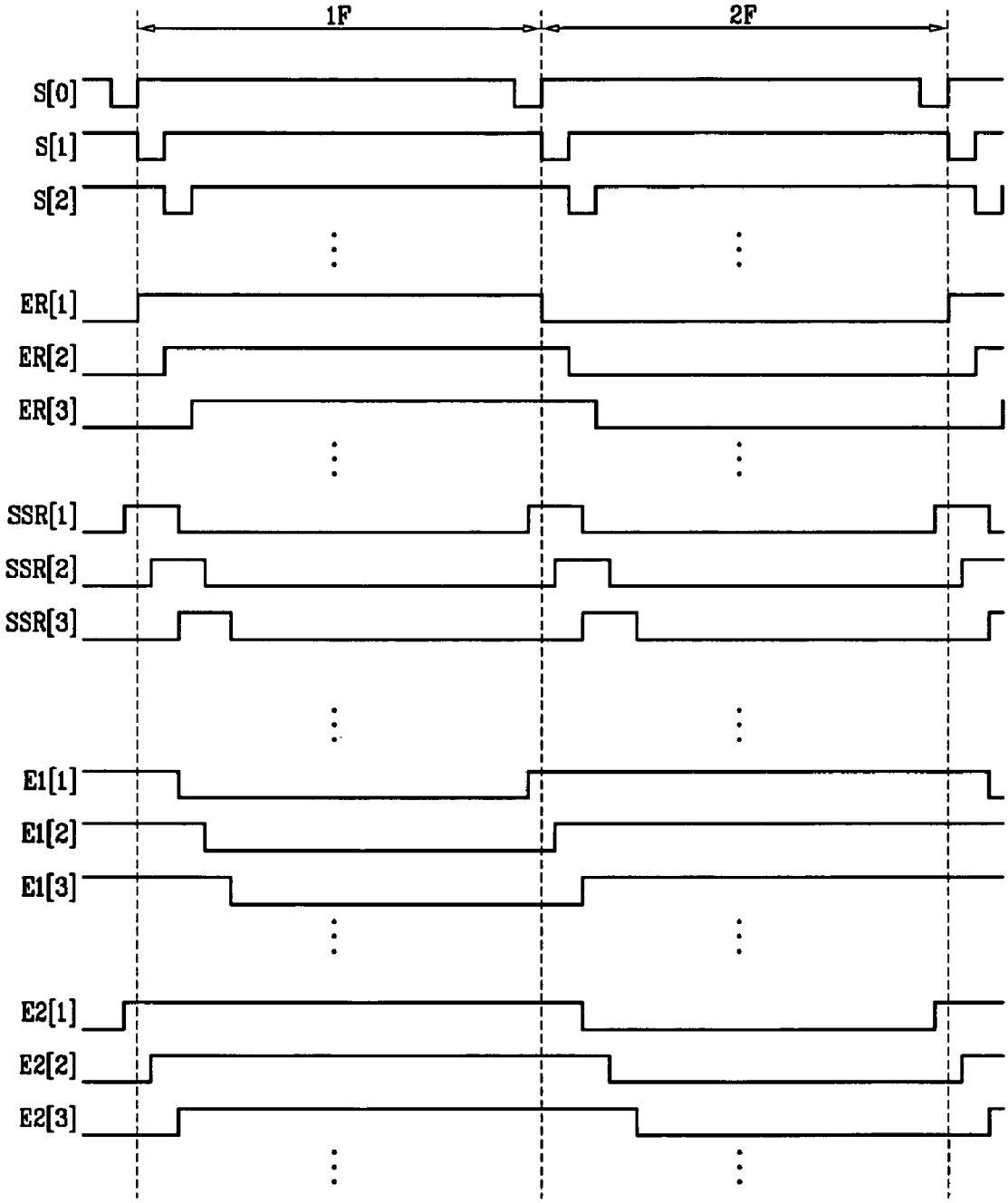
FIG. 15 is a timing diagram of input and output signals of the emission control signal unit of FIG. 14.

FIG. 14 is a schematic diagram of an emission control signal unit 320 according to the second exemplary embodiment of the present invention, and FIG. 15 is a timing diagram of signals SSR[1] to SSR[n+1] input to the emission control signal unit 320 and signals output from the emission control signal unit 320.

The emission control signal unit 320 according to the second exemplary embodiment of the present invention is substantially the same as the emission control signal unit 220 according to the first exemplary embodiment of the present invention except that the signals SSR[1] to SSR[n] are input to the emission control signal unit 320. The emission control signal unit 320 includes a plurality of flip flops $FF_{21}$ to $FF_{2n}$ and a plurality of logic circuit units $\mathbf{321}_1$ to $\mathbf{321}_n$. The flip flop $FF_{21}$ receives the start signal SP2 and the clock signal CLK, and generates a half clock shifted signal ER[1]. The flip flop $FF_{2i}$ receives the signal ER[i−1] generated from the flip flop $FF_{2i-1}$ and the clock signal CLK, and generates the signal ER[i].

The logic circuit unit $\mathbf{321}_i$ includes two inverters $\mathbf{322}_i$ and $\mathbf{325}_i$, a NAND gate $\mathbf{323}_i$, and a NOR gate $\mathbf{324}_i$. The logic circuit unit $321_i$ receives the signal SSR[i] output from the selection signal unit 310 and the signal ER[i] output from the flip flop $FF_{2i}$, and generates emission control signals E1[i] and E2[i]. The inverter $322_i$ receives the signal SSR[i] output from the selection signal 310, and the NAND gate $323_i$ receives the output signal/SSR[i] of the inverter $322_i$ and the signal ER[i] output from the flip flop $FF_{2i}$. The NOR gate $324_i$ receives the signal SSR[i] and the signal ER[i]. The inverter $325_i$ inverts the output of the NOR gate $324_i$.

Operation of the flip flop $FF_{21}$ and the logic circuit unit $321_1$ will now be described.

As can be seen from FIG. 14 and FIG. 15, when the signal ER[1] is at a high level in a first field, the NAND gate $323_1$ outputs the inverted signal of another input. That is, the NAND gate $323_1$ outputs the inverted signal SSR[1] of the output signal/SSR[1] of the inverter $322_1$. The NOR gate $324_1$ receives the high level signal ER[1], and outputs a high level signal regardless of the signal SSR[1]. Accordingly, a signal corresponding to the signal SSR[1] is output as the emission control signal E1[1] in the first field 1F, and the emission control signal E2[1] is at the high level for a period of the signal SSR[1].

That is, the emission control signal E1[1] is at the high level when the signal SSR[1] is at the high level, and at the low level when the signal SSR[1] is at the low level in the first field 1F. The emission control signal E2[1] is at the high level when the signal SSR[1] is at the high level, and at the high level when the signal SSR[1] is at the low level. Accordingly, no current is applied to the OLED elements OLED1 and OLED2 while the signal SSR[1] is at the high level. When the transistor M21 is turned on in response to the emission control signal E1[1], a current is applied to the OLED element OLED1, and the OLED element OLED1 is emitted while the signal SSR[1] is at the low level. The emission control signal E2[1] is at the low level for a predetermined time Td and the transistor M22 is turned on for the predetermined time Td when the selection signal S[0] is at the low level. That is, the transistor M3 is turned on by the low level selection signal S[0], the transistor M22 is turned on for the predetermined time Td, and therefore the gate node of the transistor M1, that is, the capacitor Cvth, is initialized.

When the signal ER[1] is at the low level in the second field 2F, the NAND gate $323_1$ outputs a high level signal as the emission control signal E1[1] regardless of another input. The NOR gate $324_1$ receives the low level signal ER[1] and outputs the inverted signal/SSR[1] of the SSR[1]. The signal/SSR[1] is inverted by the inverter $325_1$, and the signal SSR[1] is output as the emission control signal E2[1]. Accordingly, a signal corresponding to the signal SSR[1] is output as the emission control signal E2[1] in the second field 2F, and the emission control signal E1[1] is at the high level for a period of the signal SSR[1].

That is, the emission control signal E2[1] is at the high level while the signal SSR[1] is at the high level, and at the low level while the signal SSR[1] is at the low level in the second field 2F. The emission control signal E1[1] is at the high level while the signal SSR[1] is at the high level, and at the high level while the signal is at the low level in the second field 2F. Accordingly, no current is applied to the OLED elements OLED1 and OLED2 while the signal SSR[1] is at the high level. When the transistor M22 is turned on in response to the emission control signal E2[1], a current is applied to the OLED element OLED2, and the OLED element OLED1 is emitted while the signal SSR[1] is at the low level. The emission control signal E1[1] is at the low level for the predetermined time Td and the transistor M21 is turned on for the predetermined time Td when the low level selection signal S[0] is applied in the second field. That is, the transistor M3 is turned on by the low level selection signal S[0], the transistor M21 is turned on for the predetermined time Td, and therefore the gate node of the transistor M1, that is, the capacitor Cvth, is initialized.

The respective logic circuit units $321_2$ to $321_n$ generate the emission control signals E1[2] to E1[n] corresponding to the signals SSR[2] to SSR[n] and the high level emission control signals E2[2] to E2[n] in the first field. The respective logic circuits $321_2$ to $321_n$ generate emission control signals E2[2] to E2[n] corresponding to the signals SSR[2] to SSR[n] and the high level emission control signals E1[2] to E1[n] in the second field.

As shown, two emission control signals are generated by one shift register by using logic gates including a NAND gate, a NOR gate, and two inverters. Accordingly, the selection/emission control driver for generating and outputting an emission control signal is efficiently realized, the number of the transistors forming the driver is reduced, a circuit area is reduced, and therefore an error rate generated by the transistor is reduced.

An OLED light emitting display according to a third exemplary embodiment of the present invention will be described with reference to FIG. 16 to FIG. 18.

The OLED light emitting display according to the third exemplary embodiment of the present invention is substantially the same as the OLED light emitting display according to the first exemplary embodiment of the present invention except that an enable signal enb is further applied to a selection signal unit 410 of a selection/emission control driver 400. Accordingly, the selection signal unit 410 to which the enable signal enb is applied and signals output from the selection signal unit 410 will be described, and the description of an emission control signal unit 420 will be omitted because it is substantially the same as that of the first exemplary embodiment.

Figure 16:
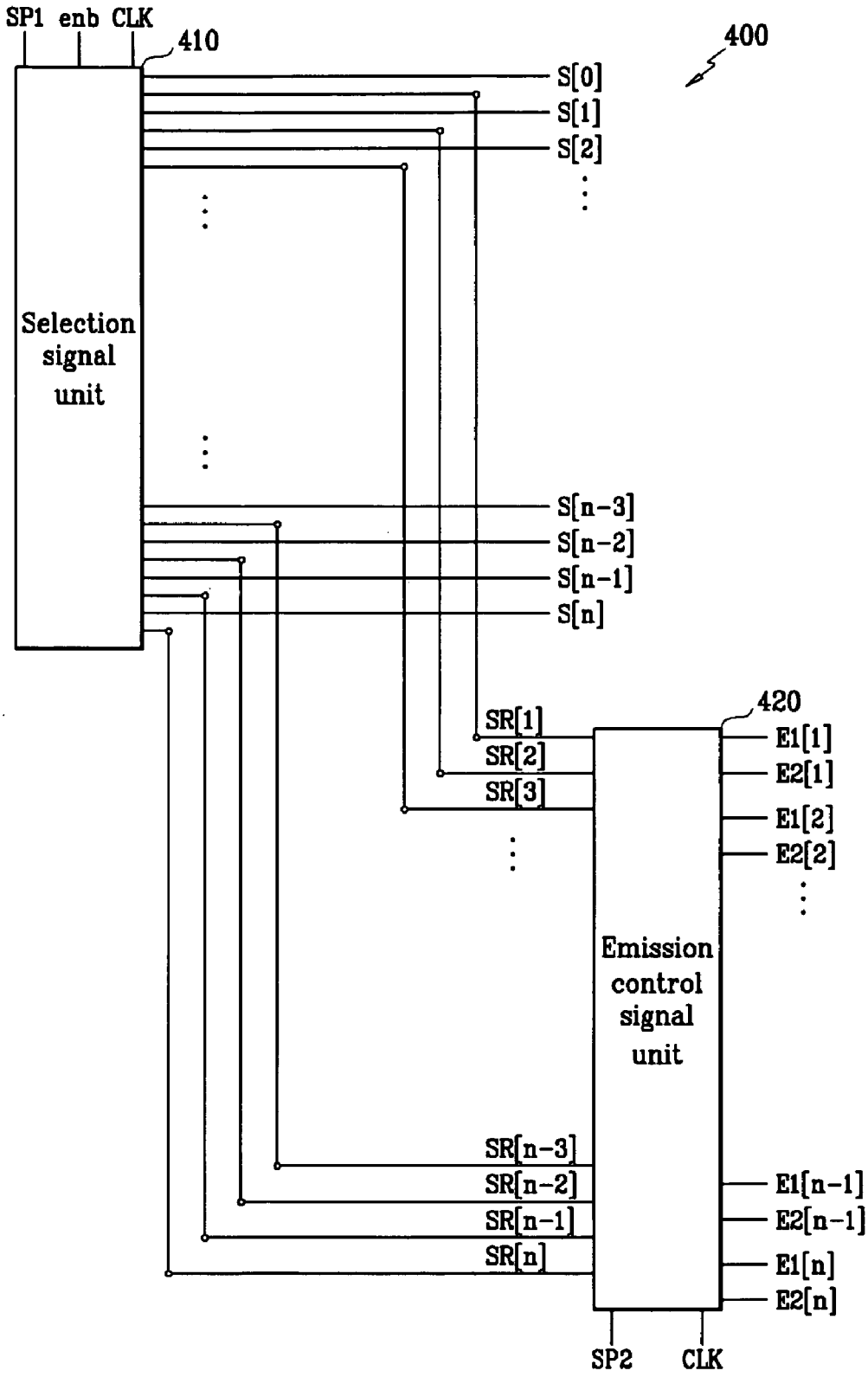
FIG. 16 is a schematic diagram illustrating a configuration of a selection/emission control driver 400 of an OLED light emitting display according to a third exemplary embodiment of the present invention.
Figure 17:
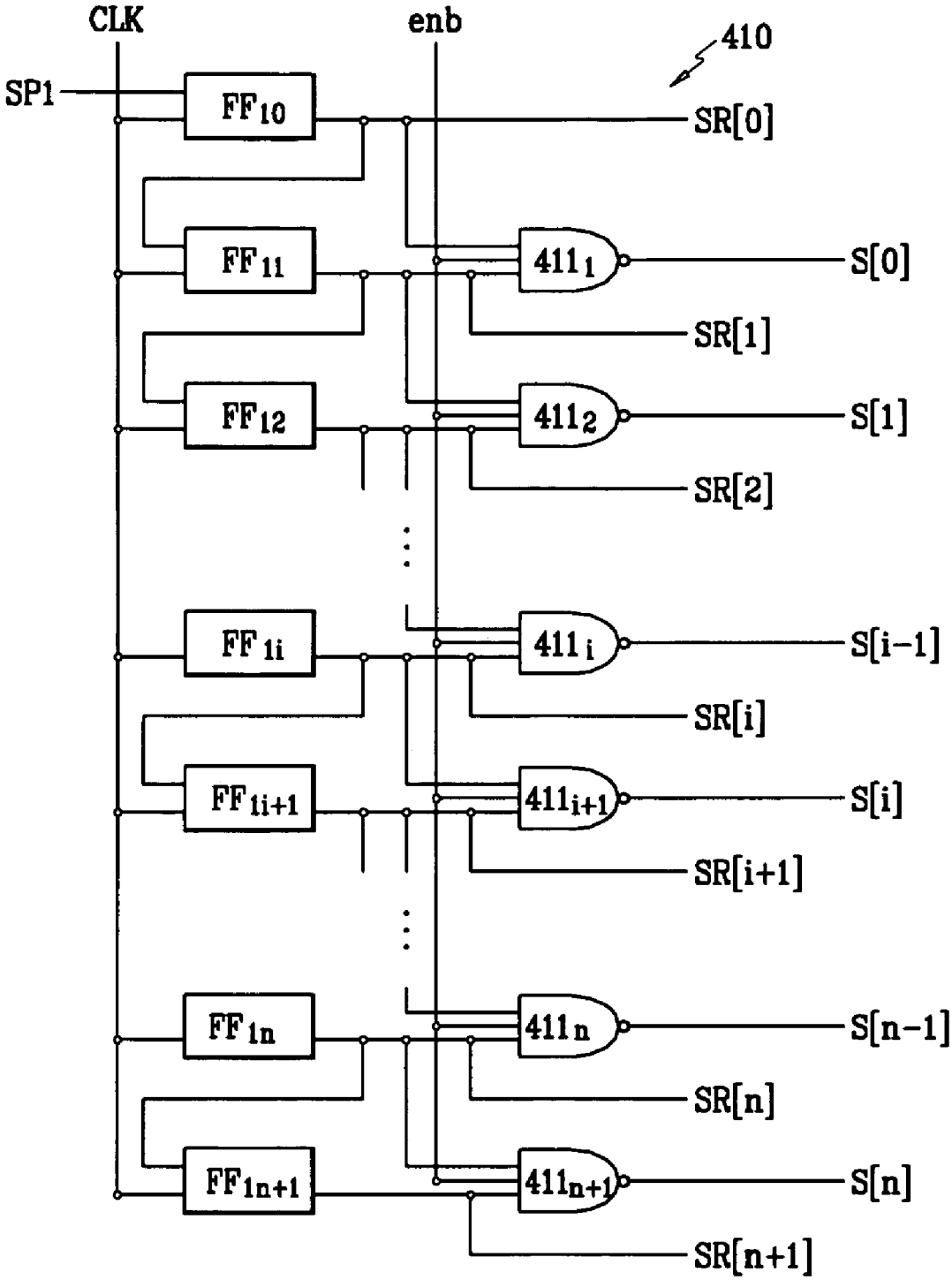
FIG. 17 is a schematic diagram illustrating a configuration of a selection signal unit in the selection/emission control driver 400 of FIG. 16.
Figure 18:
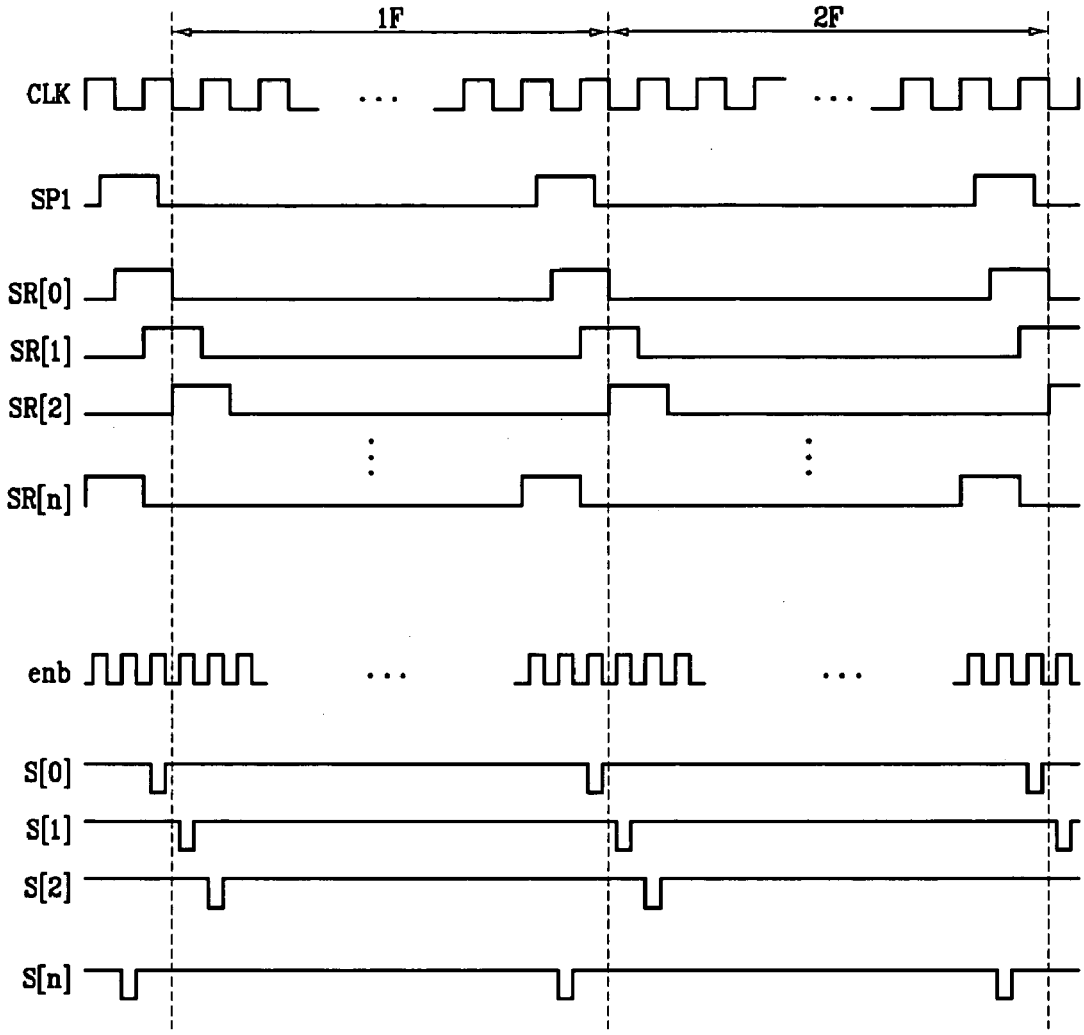
FIG. 18 is a signal timing diagram of an operation of the selection signal unit of FIG. 17.

FIG. 16 is a schematic diagram of the selection/emission control driver 400 of the OLED light emitting display according to the third exemplary embodiment of the present invention, FIG. 17 is a schematic diagram of the selection signal unit 410, and FIG. 18 is a signal timing diagram of an operation of the selection signal unit 410. The selection/emission control driver 400, for example, can be used as the selection/emission control driver 200 of FIG. 2.

As shown in FIG. 16, the selection/emission control driver 400 includes the selection signal unit 410 and the emission control signal unit 420. The selection signal unit 410 receives the start signal SP1, the clock signal CLK, and the enable signal enb, and generates the selection signals S[0] to S[n] and the signals SR[0] to SR[n]. The emission control signal unit 420 receives, correspondingly with the emission control signal unit 220 according to the first exemplary embodiment, the signals SR[1] to SR[n] from the selection signal unit 410, the start signal SP2, and the clock signal CLK, and outputs the emission control signals E1[1] to E1[n] and the emission control signals E2[1 ] to E2[n].

As shown in FIG. 17, the selection signal unit 410, correspondingly with the selection signal unit 210 according to the first exemplary embodiment shown in FIG. 6, includes a plurality of flip flops $FF_{1i}$ and a plurality of NAND gates $411_i$. The plurality of NAND gates $411_i$ correspond to the plurality of NAND gates $211_i$ according to the first exemplary embodiment except that the NAND gate $411_i$ receives the output signal of the previous flip flop $FF_{1i-1}$, the output signal of the present flip flop $FF_{1i}$, and the enable signal enb.

As can be seen from FIG. 17 and FIG. 18, the NAND gate 411$_i$ outputs the selection signal S[i] having the low level when the output signal of the flip flop $FF_{1i-1}$, the signal of the present terminal of the flip flop $FF_{1i}$, and the enable signal enb are at the high level. That is, the low level selection signal S[0] is output when the signal SR[0], signal SR[1], and the enable enb are at the high level.

As shown, the low level selection signal S[i+1] is applied after a predetermined time is passed when the low level selection signal S[i] is applied, and therefore an erroneous operation caused by a signal delay will be prevented.

While the enable signal is further applied to the selection signal unit according to the first exemplary embodiment of the present invention in the third exemplary embodiment of the present invention, the enable signal may further be applied to the second exemplary embodiment of the present invention as well.

According to the exemplary embodiments of the present invention, an apparatus for generating an emission control signal uses logic gates including one NAND gate, one NOR gate, and two inverters, and therefore two signals are generated by using one shift register.

Accordingly, the apparatus for generating the emission control signals is efficiently realized, the number of the transistors forming the driver is reduced, a circuit area is reduced, and an error rate generated by the transistor is reduced While the present invention has been described with two light emitting elements, five transistors, and two capacitors being provided in a pixel circuit, the present invention covers the modifications and variations in which a pixel circuit includes an emitting control transistor coupled between a driving circuit and the light emitting element. The present invention also covers the modifications and variations in which an apparatus generates two signals with reference to a signal generated from one shift register. That is, it will be apparent to those skilled in the art that various modifications and variation can be made in the present invention without departing from the spirit or scope of the invention. Thus, it is intended that the present invention cover the modifications and variations,of this invention that come within the scope of the appended claims and their equivalents.

What is claimed is:

1. A light emitting display comprising:

a display area including a plurality of data lines for transmitting data signals for displaying an image, a plurality of selection signal lines for transmitting a selection signal, a plurality of first and second emission control signal lines for transmitting first and second emission control signals, and a plurality of pixels respectively coupled to the data lines and the selection signal lines;

a scan driver for generating a first signal having a first pulse and shifting the first signal by a first period, and shifting the selection signal having a second pulse by the first period using the first signal and sequentially transmitting the selection signal to the plurality of selection signal lines in a first field and a second field; and an emission control driver for generating a second signal having a third pulse and shifting the second signal by the first period in the first field and the second field, for shifting the first emission control signal having a fourth pulse by the first period using the first signal and the second signal and sequentially transmitting the first emission control signal to the plurality of first emission control signal lines in the first field, and for shifting the second emission control signal having a fifth pulse by the first period using the first signal and the second signal and sequentially transmitting the second emission control signal to the plurality of second emission control signal lines in the second field, wherein at least one of the pixels comprises first and second light emitting elements, the first light emitting element is emitted by the fourth pulse of the first emission control signal in the first field, and the second light emitting element is emitted by the fifth pulse of the second emission control signal in the second field.

2. The light emitting display of claim 1, wherein one of the data signals corresponding to the first light emitting element is transmitted to a corresponding one of the data lines while the second pulse of the selection signal is applied in the first field, and another one of the data signals corresponding to the second light emitting element is transmitted to the corresponding one of the data lines while the second pulse of the selection signal is applied in the second field.

3. The light emitting display of claim 1, wherein the scan driver comprises:

a shift register for shifting the first signal having the first pulse by the first period and generating the first signal; and a first circuit unit for outputting the selection signal having the second pulse when the first pulse of the first signal and the first pulse of the first signal shifted by the first period are concurrently applied.

4. The light emitting display of claim 1, wherein the emission control driver comprises:

a shift register for shifting the second signal having the third pulse by the first period and generating the second signal;

a second circuit unit for outputting the first signal having the first pulse as the first emission control signal in a period when the third pulse of the second signal is applied; and a third circuit unit for outputting the first signal having the first pulse as the second emission control signal in a period when the third pulse of the second signal is not applied.

5. The light emitting display of claim 1, wherein a period in which the third pulse of the second signal is applied corresponds to the first field.

6. A light emitting display comprising:

a display area including a plurality of data lines for transmitting a data signal for displaying an image, a plurality of selection signal lines for transmitting a selection signal, a plurality of first and second emission control signal lines for transmitting first and second emission control signals, and a plurality of pixels respectively coupled to the data lines and the selection signal lines;

a scan driver for generating a first signal having a first pulse and shifting the first signal by a first period, for shifting the selection signal having a second pulse by the first period using the first signal and sequentially transmitting the selection signal to the plurality of selection signal lines, and for generating a second signal in which the first pulse of the first signal is shifted by a second period, in a first field and a second field; and an emission control driver for generating a third signal having a third pulse and shifting the third signal by the first period in the first field and the second field, for sequentially transmitting the first emission control signal having a fourth pulse to the plurality of first emission control signal lines using the second signal and the third signal in the first field, and for sequentially transmitting the second emission control signal having a fifth pulse to the plurality of second emission control signal lines using the second signal and the third signal in the second field, wherein at least one of the pixels comprises first and second light emitting elements, the first light emitting element is emitted by the fourth pulse of the first emission control signal in the first field, and the second light emitting element is emitted by the fifth pulse of the second emission control signal in the second field.

7. The light emitting display of claim 6, wherein the scan driver comprises:

a shift register for shifting the first signal having the first pulse by the first period and sequentially generating the first signal;

a first circuit unit for outputting the selection signal having the second pulse when the first pulse of the first signal and the first pulse of the first signal shifted by the first period are concurrently applied; and a second circuit unit for shifting the first pulse of the first signal by the second period.

8. The light emitting display of claim 7, wherein the second circuit unit comprises:

a third circuit unit for receiving the first signal and a sixth signal having the first pulse, and generating a seventh signal having the first pulse when the first pulse of the first signal and the first pulse of the sixth signal are concurrently applied;

a fourth circuit unit for receiving a signal which is generated by shifting the first signal by the first period and an inversion signal of the sixth signal, and generating an eighth signal having the first pulse when the first pulse of the signal generated by shifting the first signal by the first period and the first pulse of the inversion signal of the sixth signal are concurrently applied; and a fifth circuit unit for receiving the seventh and eighth signals, and generating the second signal.

9. The light emitting display of claim 8, wherein the third and fourth circuit units comprise NAND gates, and the fifth circuit unit comprises an OR gate.

10. The light emitting display of claim 6, wherein the emission control driver comprises:

a shift register for shifting a third signal having the third pulse by the first period and sequentially generating the third signal;

a sixth circuit unit for outputting the second signal having the first pulse as the first emission control signal in a period when the third pulse of the third signal is applied; and a seventh circuit unit for outputting the second signal having the first pulse as the second emission control signal in a period when the third pulse of the third signal is not applied.

11. A light emitting display comprising:

a plurality of selection signal lines for transmitting as election signal;

a plurality of first and second emission control signal lines for respectively transmitting first and second emission control signals; and a scan driver for generating the selection signal and the first and second emission control signals, applying the selection signal to the selection signal lines, and applying the first and second emission signals to the first and second emission control signal lines, wherein the scan driver comprises:

a selection signal unit for generating a first shift signal to be sequentially shifted, sequentially generating the selection signal using the first shift signal, and applying the selection signal to the selection signal lines; and an emission control signal unit for generating a second shift signal to be sequentially shifted, generating the first and second emission control signals using the first shift signal and the second shift signal, and respectively applying the first and second emission control signals to the first and second emission control signal lines.

12. The light emitting display of claim 11, wherein the selection signal unit comprises:

a shift register for receiving a first clock signal and a start signal, and sequentially generating the first shift signal; and a first circuit unit for outputting the selection signal using the first shift signal.

13. The light emitting display of claim 12, wherein the first circuit unit generates the selection signal using two sequential first shift signals.

14. The light emitting display of claim 13, wherein the first circuit unit outputs the selection signal having a second level while the two sequential first shift signals have a first level.

15. The light emitting display of claim 14, wherein the first level is a high level, the second level is a low level, and the first circuit unit comprises a NAND gate.

16. The light emitting display of claim 11, wherein the emission control signal unit comprises:

a shift register for receiving a second clock signal and a start signal, and generating the second shift signal; and a second circuit unit for outputting the first and second emission control signals using the second shift signal and the first shift signal.

17. The light emitting display of claim 16, wherein the second circuit unit comprises:

a third circuit unit for outputting the first shift signal as the first emission control signal when the second shift signal is at a first level; and a fourth circuit unit for outputting the first shift signal as the second emission control signal when the second shift signal is at a second level.

18. The light emitting display of claim 17, wherein the first level is a high level, and the second level is a low level.

19. The light emitting display of claim 18, wherein the third circuit unit comprises:

an inverter for receiving the first shift signal; and a NAND gate for receiving an output of the inverter and the second shift signal.

20. The light emitting display of claim 18, wherein the fourth circuit unit comprises:

a NOR gate for receiving the first shift signal and the second shift signal; and an inverter for inverting the output signal of the NOR gate.

21. A light emitting display comprising:

a plurality of selection signal lines for transmitting a selection signal;

a plurality of first and second emission control signal lines for respectively transmitting first and second emission control signals; and a scan driver for generating the selection signal and the first and second emission control signals, applying the selection signal to the selection signal lines, and applying the first and second emission control signals to the first and second emission control signal lines, wherein the scan driver comprises:

a selection signal unit for generating a first shift signal to be sequentially shifted, sequentially generating the selection signal using the first shift signal, applying the selection signal to the selection signal lines, and generating a second shift signal using the first shift signal; and an emission control signal unit for generating a third shift signal to be sequentially shifted, sequentially generating the first and second emission control signals using the second shift signal and the third shift signal, and respectively applying the first and second emission control signals to the first and second emission control signal lines.

22. The light emitting display of claim 21, wherein the selection signal unit comprises:

a shift register for receiving a first clock signal and a start signal, and sequentially generating the first shift signal;

a first circuit unit for outputting the selection signal using the first shift signal; and a second circuit unit for outputting the second shift signal using the first shift signal.

23. The light emitting display of claim 22, wherein the second circuit unit generates the second shift signal using two sequential first shift signals and a second clock signal.

24. The light emitting display of claim 23, wherein the second clock signal leads the first clock signal by the first period, and the second shift signal lags behind the first shift signal by the first period.

* * * * *

UNITED STATES PATENT AND TRADEMARK OFFICE

CERTIFICATE OF CORRECTION

PATENT NO. : 7,256,775 B2
APPLICATION NO. : 11/155995
DATED : August 14, 2007
INVENTOR(S) : Ki-Myeong Eom It is certified that error appears in the above-identified patent and that said Letters Patent is hereby corrected as shown below:

| | |
|---|---|
| Column 21, lines 59-60, Claim 11 | Delete "as election",<br>Insert --a selection-- |

Signed and Sealed this

Sixteenth Day of September, 2008

JON W. DUDAS
*Director of the United States Patent and Trademark Office*